US009800007B2

(12) United States Patent
Chou

(10) Patent No.: US 9,800,007 B2
(45) Date of Patent: Oct. 24, 2017

(54) CRIMPING TOOL

(71) Applicant: JETOOL CORP., New Taipei (TW)

(72) Inventor: Chien-Hung Chou, New Taipei (TW)

(73) Assignee: JETOOL CORP., New Taipei (TW)

( * ) Notice: Subject to any disclaimer, the term of this patent is extended or adjusted under 35 U.S.C. 154(b) by 312 days.

(21) Appl. No.: 14/840,059

(22) Filed: Aug. 31, 2015

(65) Prior Publication Data

US 2015/0372436 A1 Dec. 24, 2015

(30) Foreign Application Priority Data

Sep. 10, 2014 (TW) ..... 103216057 U

(51) Int. Cl.
*H01R 43/042* (2006.01)
*H01R 43/048* (2006.01)
*H01R 9/05* (2006.01)

(52) U.S. Cl.
CPC ..... *H01R 43/042* (2013.01); *H01R 9/0518* (2013.01); *H01R 43/0488* (2013.01); *Y10T 29/53235* (2015.01)

(58) Field of Classification Search
CPC ..... H01R 43/042; H01R 43/048; H01R 43/0488; H01R 43/0425; Y10T 29/53209; Y10T 29/53213; Y10T 29/53222; Y10T 29/53226; Y10T 29/53235; Y10T 29/53257
USPC ..... 72/712; 29/747, 748, 750, 751, 753, 758
See application file for complete search history.

(56) References Cited

U.S. PATENT DOCUMENTS

| | | | | |
|---|---|---|---|---|
| 7,225,532 | B2 * | 6/2007 | Wei | H01R 43/042 29/278 |
| 7,761,949 | B1 * | 7/2010 | Hughes, IV | B25G 3/36 15/144.1 |
| 8,006,537 | B2 * | 8/2011 | Liu | B25B 27/10 72/409.08 |
| 8,677,610 | B2 * | 3/2014 | Liu | H01R 43/042 29/751 |
| 9,219,342 | B2 * | 12/2015 | Liao | H01R 43/0425 |
| 2006/0032048 | A1 * | 2/2006 | Liao | H01R 43/042 29/750 |
| 2011/0154651 | A1 * | 6/2011 | Liu | H01R 9/05 29/750 |

FOREIGN PATENT DOCUMENTS

| | | |
|---|---|---|
| TW | M322099 | 11/2007 |

* cited by examiner

*Primary Examiner* — A. Dexter Tugbang
*Assistant Examiner* — Joshua D Anderson
(74) *Attorney, Agent, or Firm* — JCIPRNET

(57) ABSTRACT

The invention is related to a crimping tool. The crimping tool includes a connection rod having one end pivotally connected to the first handle and the other end of the connection rod pivotally connected to a crimp section. A first screw rod is disposed at the second handle of the crimping tool. The first screw rod drives the connector which leads the first handle to displace. The movement of the first handle leads a connection rod to displace. As a result, the position of a crimp section on the first handle can be adjusted.

11 Claims, 34 Drawing Sheets

CRIMPING TOOL

BACKGROUND OF THE INVENTION

1. Field of the Invention

The invention relates to crimping tools and more particularly to a crimping tool having an adjustable crimp section.

2. Description of Related Art

A coaxial cable is a type of electric cable which has two conductors that share a common axis. Coaxial cables are popularized by applications in transferring communication signals, cable TV, etc. There are many applications that a coaxial cable can find itself playing an important role. Therefore, crimping a coaxial plug and a coaxial cable together has become an important subject. Taiwanese Utility Model Number M322099, entitled "crimping tool" is disclosed. The Taiwanese Utility Model Number M322099 can achieve a task of crimping a coaxial plug and a coaxial cable together. However, in terms of dealing with coaxial plugs with different specifications, the Taiwanese Utility Model Number M322099 requires that a crimp section of a crimping tool must first be unplugged from the tool in order to create a void. Consequently, a placement of a crimp section of a different specification is needed to back fill the aforementioned void before the crimping tool can be used again. The replacement of the crimp section creates inconvenience to a user. Moreover, there is a risk of losing or misplacing crimp sections that are not currently plugged in.

Due primarily to the aforementioned problems and deficiencies, the inventor of the invention set out to collect relevant data, and perform multi-faceted assessments and evaluations. After continuous trials and errors, modifications, and along with having many years of professional working experiences in the industry, a novel crimping tool which can crimp various different kinds of specification is devised.

SUMMARY OF THE INVENTION

It is therefore one object of the invention to provide a crimping tool capable of crimping a coaxial cable and a coaxial plug together. The crimping tool comprises a first handle which equips with a first through hole, a second handle which equips with a first guide section, a second guide section, a third guide section, and a fourth guide section, the second handle front section is a hollow structure, an adjustment part is disposed in the hollow structure, moreover, the adjustment part equips with a second through hole; one end of a connection rod pivotally connected with the first handle, the other end of the connection rod pivotally connected to a crimp section, one end of the crimp section is disposed in the third guide section, the other end of the crimp section of the crimp section is disposed in the fourth guide section; a connector, a first screw hole is disposed at the connector, one end of the connector is first disposed in the first guide section, followed by passing through one end of the adjustment part, followed by passing through the first through hole, followed by passing through the other end of the adjustment part, and finally be disposed in the second guide section; a first screw rod passes the second through hole and screws into the first screw hole. Hence, the rotation of the first screw rod drives the connector to displace, the connector then drives the first handle to displace, the first handle then drives the connection rod to displace. Therefore, the location of the crimp section can be adjusted.

Preferably, a first linkage rod is disposed at the first handle, one end of a first recovery spring is connected to the first linkage rod, and the other end of the first recovery spring is connected to the connection rod.

Preferably, a crimp head is disposed at the crimp section.

Preferably, a hollow support block is disposed at rear end of the second handle.

Preferably, a crimp section equips with a crimp head and a second screw hole, a second screw rod is disposed at the crimp head, the second screw rod and the second screw hole are screwed together. Hence, the rotation of the second screw rod adjusts the depth of the penetrating position inside the second screw hole. Therefore, the position adjustment of the crimp head can now be achieved.

Preferably, a first holding block and a second holding block are pivotally installed at rear end of the second handle, the first holding block is disposed next to the second holding block, an annular run through placement space which is formed by a first holding block and a second holding block.

Preferably, a first holding block and a second holding block are pivotally disposed at rear end of the second handle, the first holding block is disposed next to the second holding block, an annular run through placement space which is formed by the first holding block and the second holding block; one end of a second recovery spring connects to the first holding block, the other end of the second recovery spring connects to the second holding block.

Preferably, a first holding block is pivotally connected to rear end of the second handle, a protruding piece is disposed at the first holding block, a second holding block is pivotally connected to rear end of the second handle, a notch is disposed at the second holding block, the protruding piece is disposed inside the notch; a third recovery spring is placed above the second handle and pushes against the first holding block or the second holding block.

The operating theory of the crimping tool is characterized by adjusting the position of the crimp section, rotating the first screw rod to drive the connector to start displacing, the connector drives the first handle to displace, the first handle drives the connection rod to displace. As a result, the position of the crimp section is adjusted.

The operating theory of the crimping tool is characterized by crimping coaxial plug and coaxial cable of various specifications, adjust the first handle position which is inside the second handle to crimp coaxial cable of various specification and coaxial plug of various specification, adjusting the first handle position which is inside the second handle, and adjusting the crimp head position, i.e. adjusting the depth of the screw rod which is screwed into the screw hole, in order to crimp coaxial cable and coaxial plug that are of various specifications.

The crimping tool of the invention can increase the quality of crimp joins by utilizing an annular run through placement space which is formed by the first holding block and the second holding block that wraps around a coaxial cable being placed while performing crimp operation. The coaxial cable will not have any random movement. Therefore, the invention can increase the quality of crimp joining a coaxial cable.

The above and other objects, features and advantages of the invention will become apparent from the following detailed description taken with the accompanying drawings.

DETAILED DESCRIPTION OF THE INVENTION

Referring to FIGS. 1 to 30C, a crimping tool 100 in accordance with the invention is shown.

Figure 1:
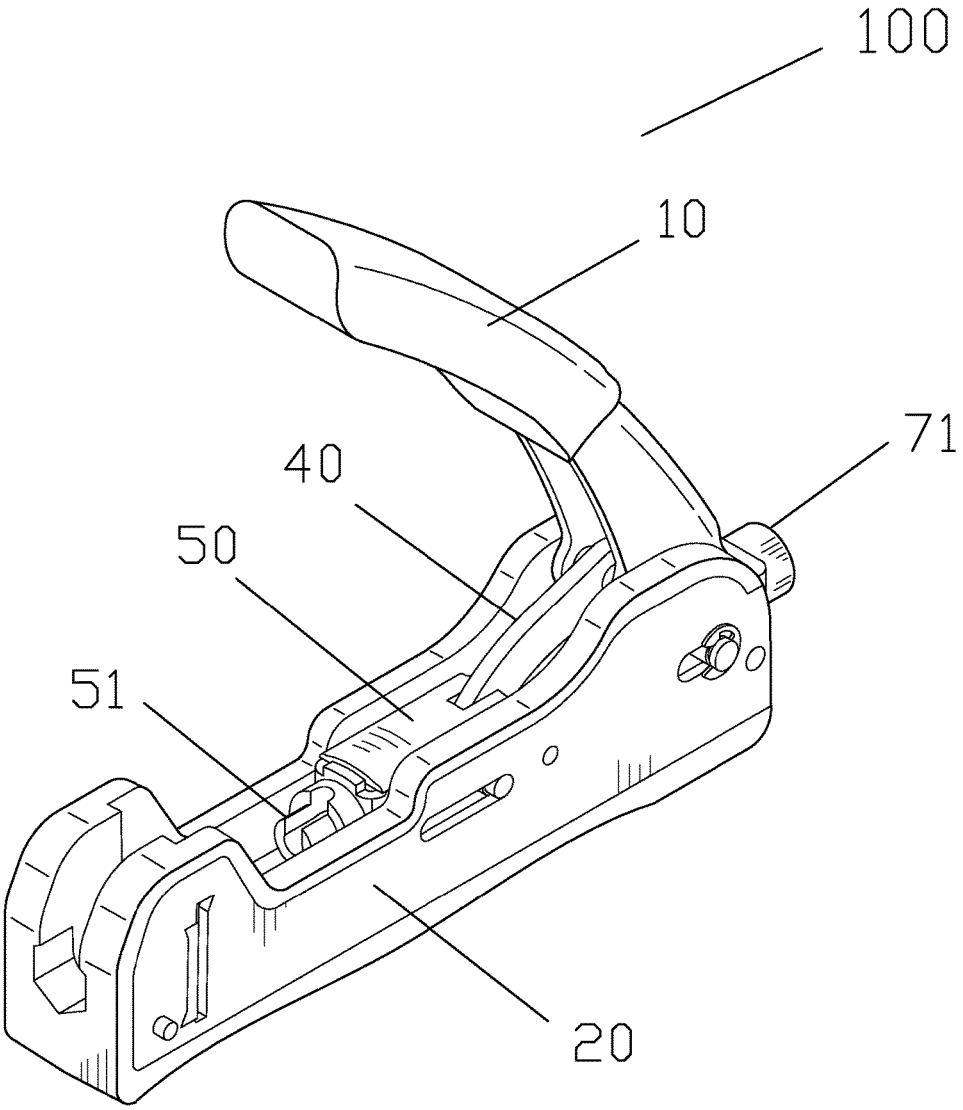
FIG. 1 is a perspective view of a crimping tool according to the invention.

In FIG. 1, the Crimping tool 100 includes a first handle 10 and a second handle 20. They are spread open relatively. Also illustrated is the connection relationship among the components.

Figure 2:
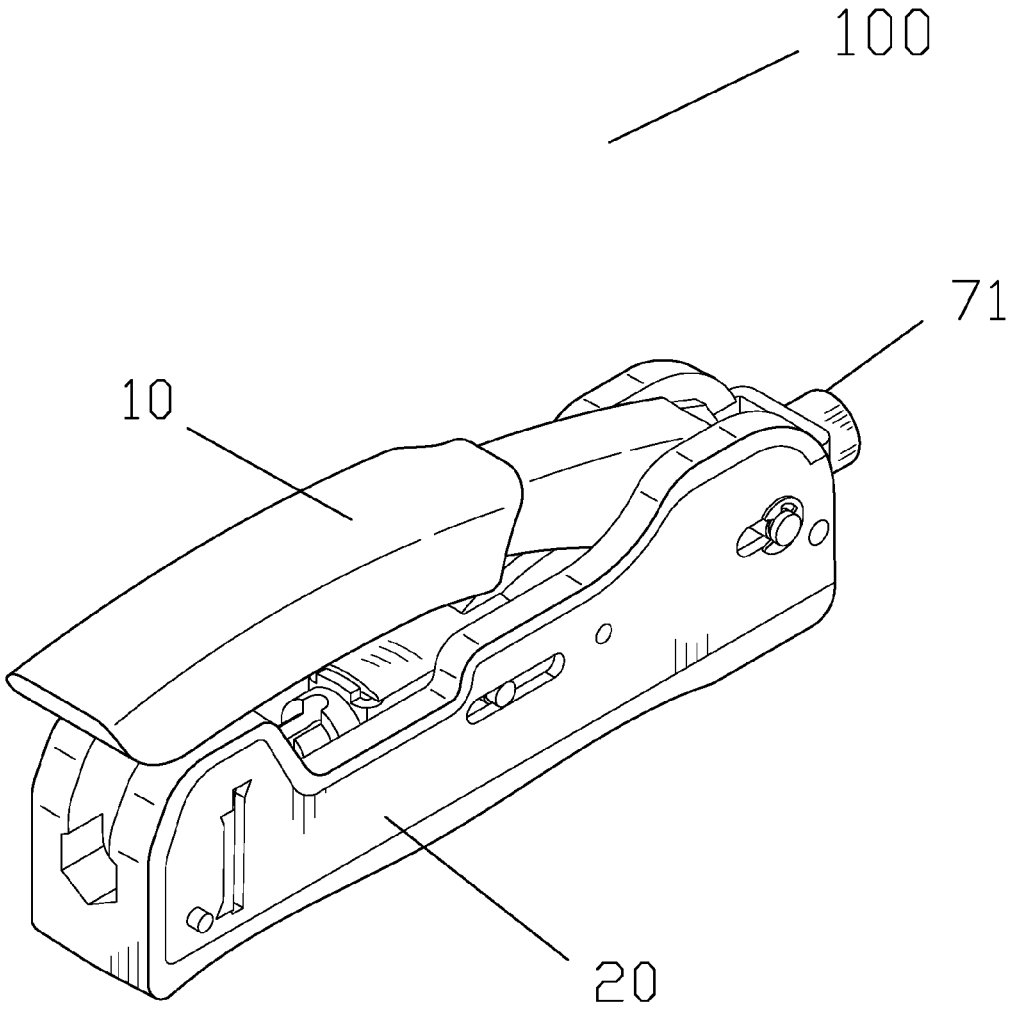
FIG. 2 is another perspective view of the crimping tool.

In FIG. 2, the first handle 10 and the second handle 20 are closed relatively. Also illustrated is the connection relationship among the components.

Figure 3:
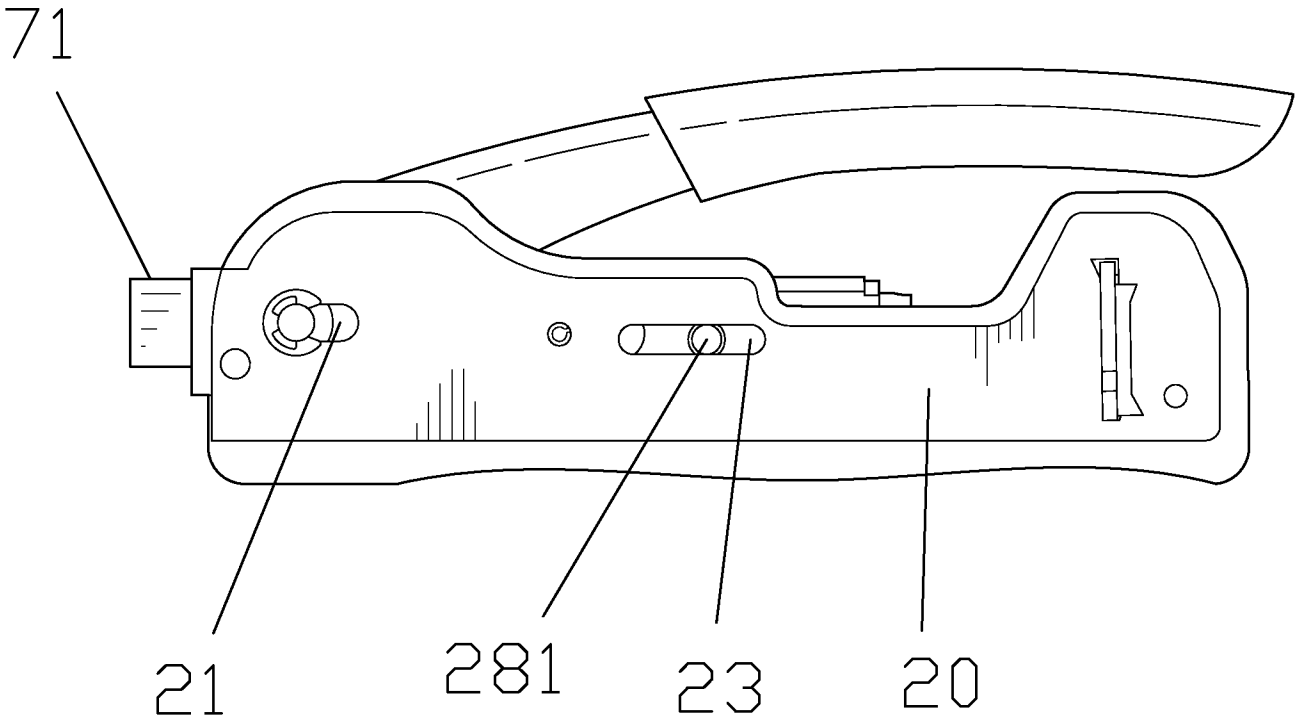
FIG. 3 is a front view of the crimping tool.

In FIG. 3, the first handle 10 and the second 20 are closed relatively. Also illustrated is the connection relationship among the components.

Figure 4:
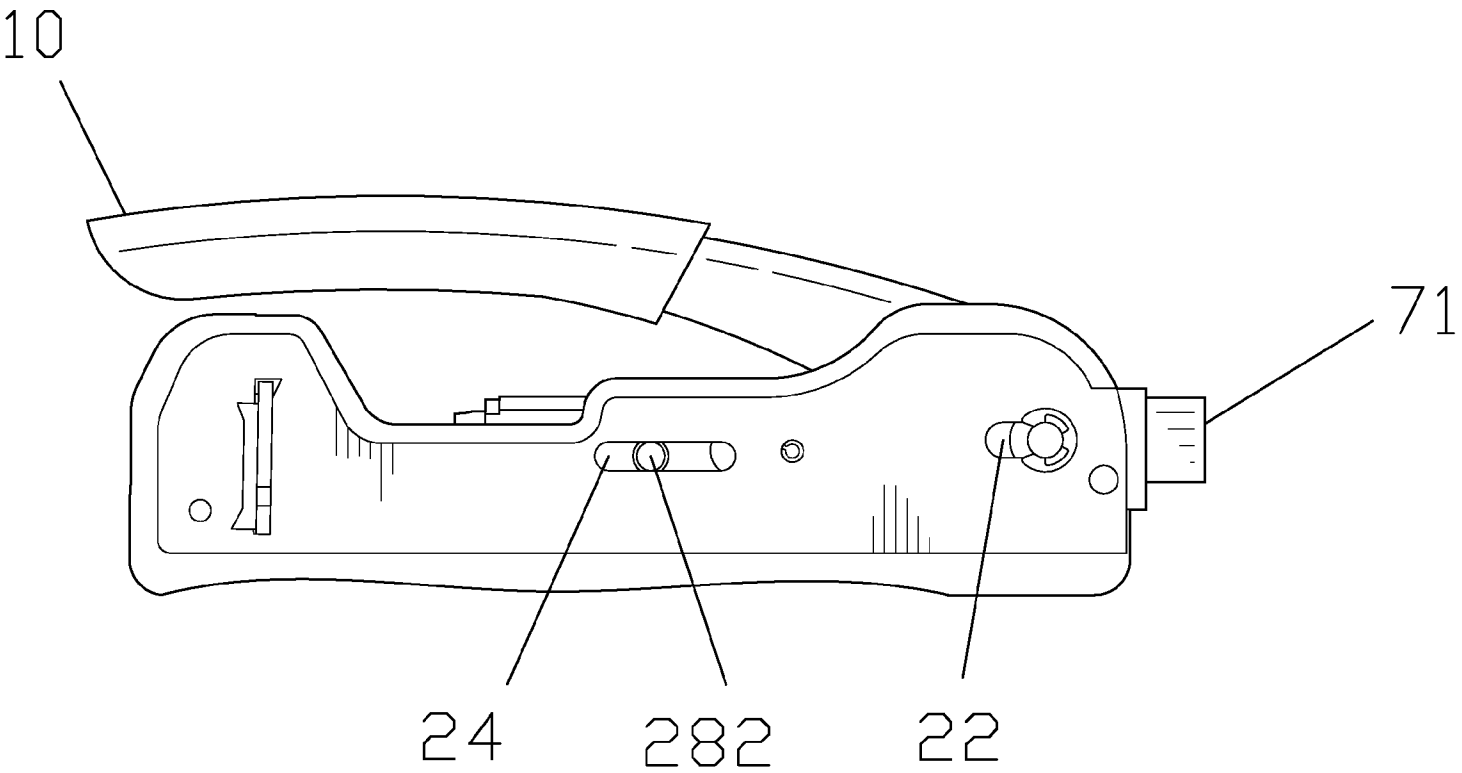
FIG. 4 is a rear view of the crimping tool.

In FIG. 4, the first handle 10 and the second handle 20 are closed relatively. Also illustrated is the connection relationship among the components.

Figure 5:
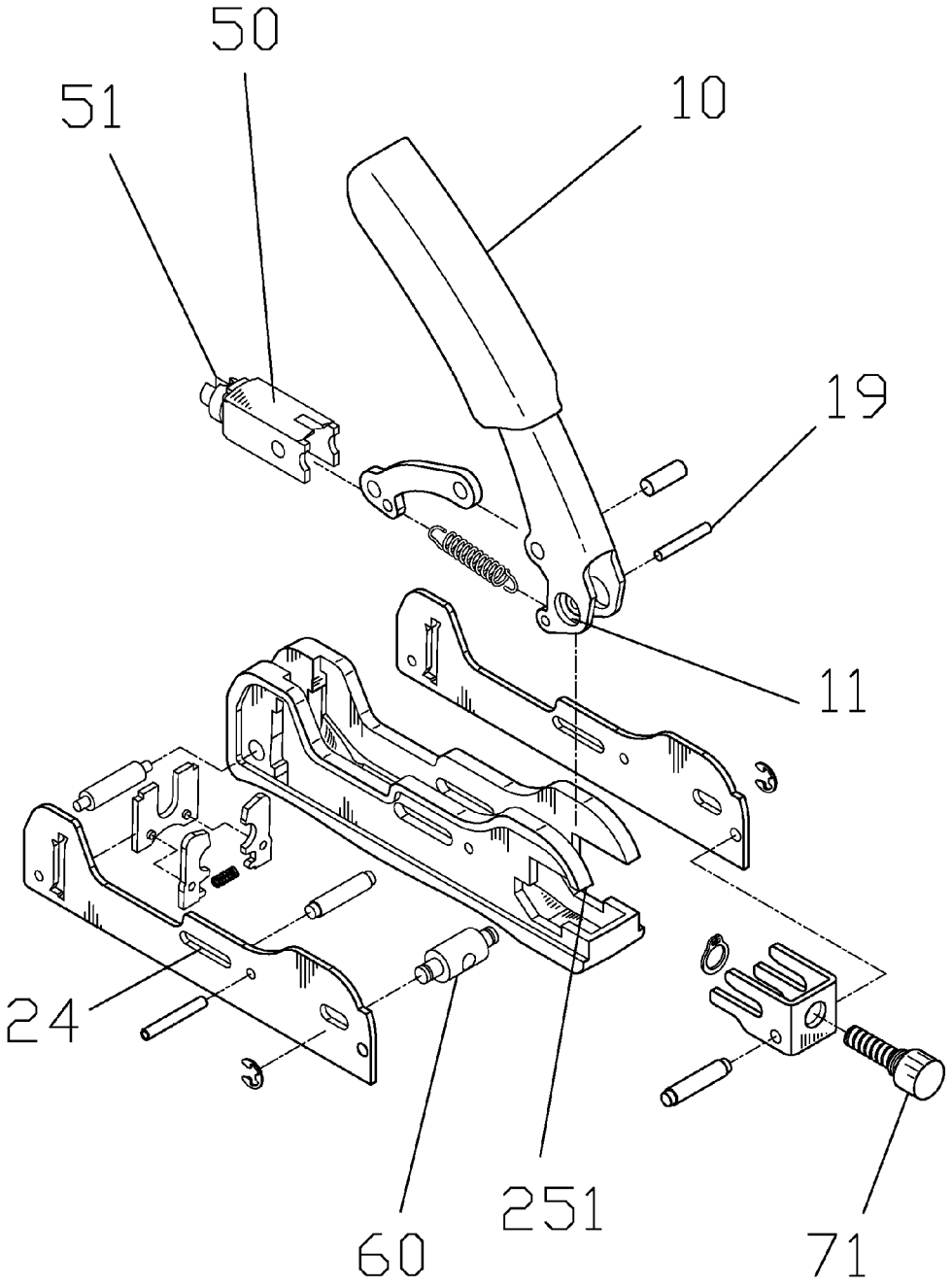
FIG. 5 is an exploded view of the crimping tool.

FIG. 5 is an exploded view of the crimping tool 100. Also illustrated is the connection relationship among the components.

Figure 6:
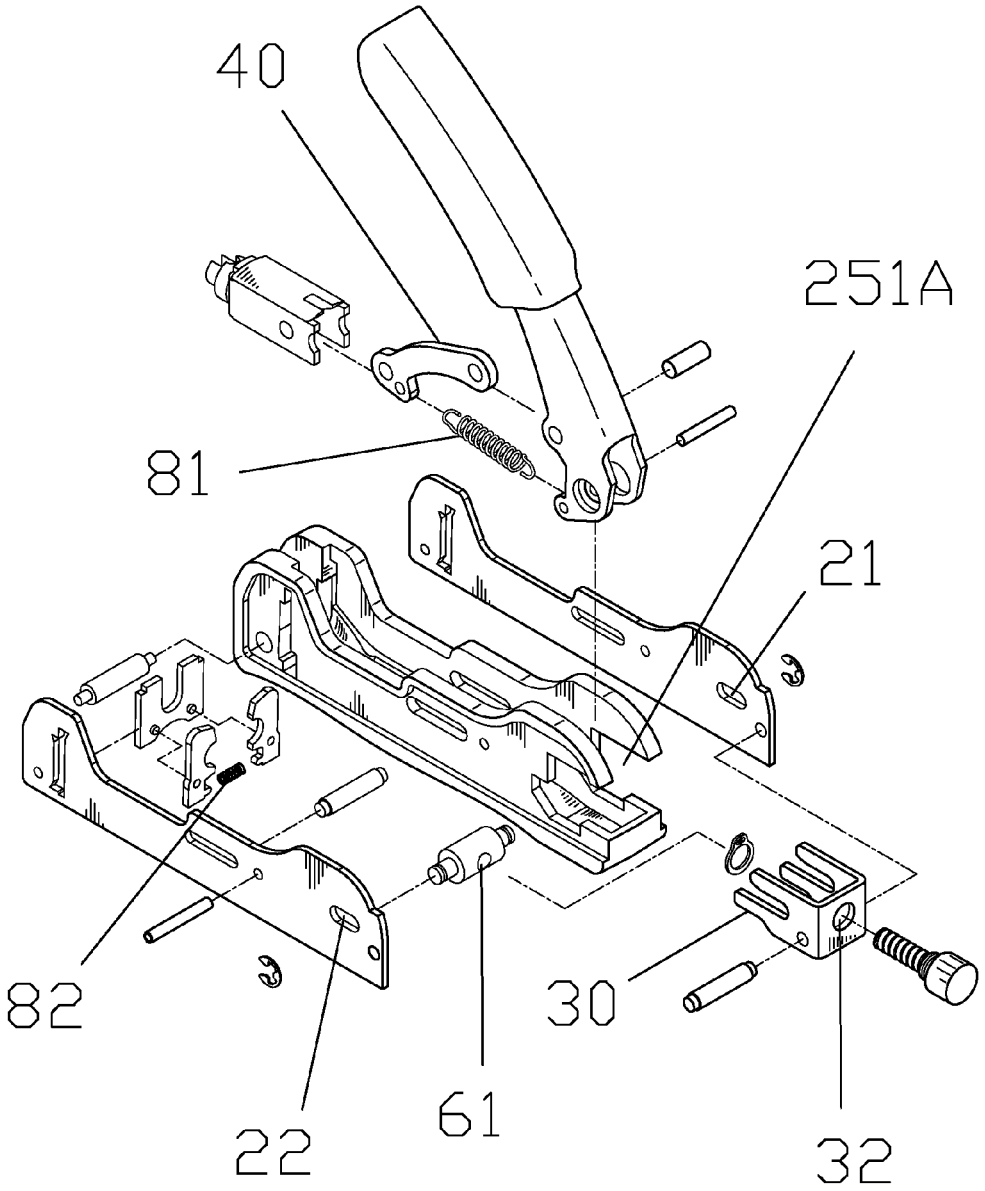
FIG. 6 is an exploded view of the crimping tool.

FIG. 6 is an exploded of the crimping tool 100. Also illustrated is the connection relationship among the components.

Figure 7:
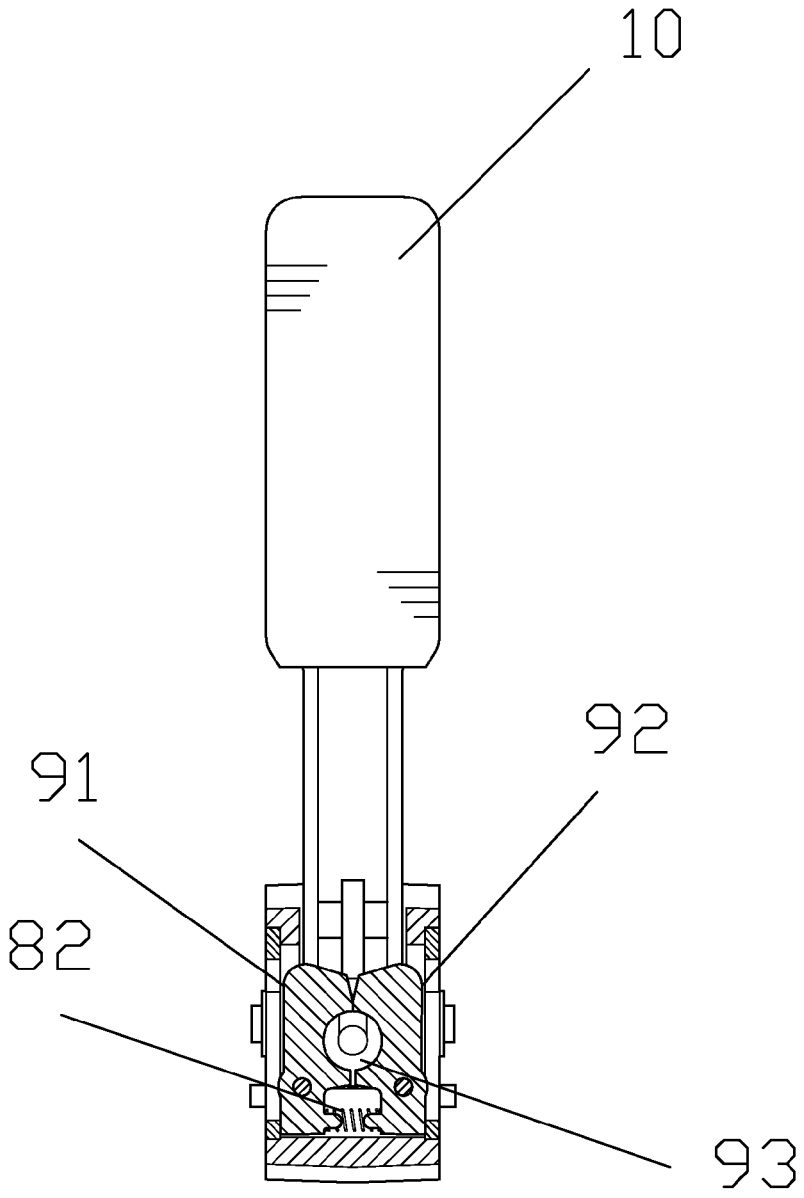
FIG. 7 is a left side view of the crimping tool.

FIG. 7 is a left side view of the crimping tool 100. The first holding block 91 and the second holding block 92 are relatively closed and form an annular run through placement space.

Figure 8:
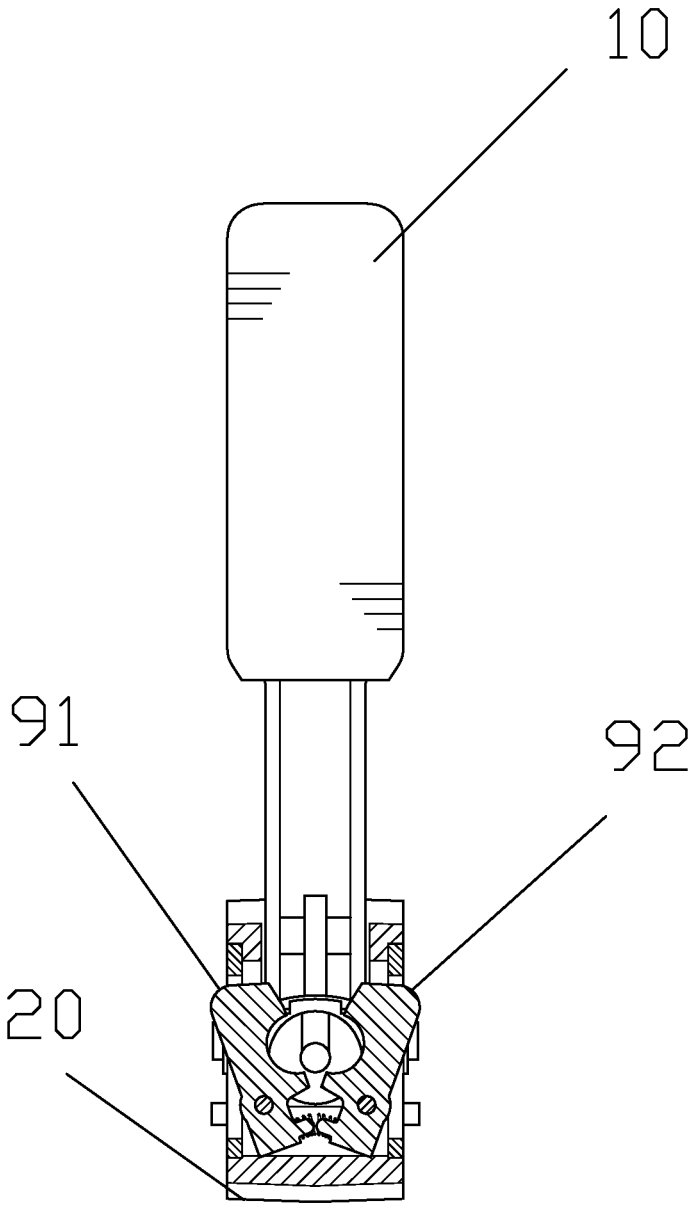
FIG. 8 is a left side view of the crimping tool.

FIG. 8 is a left side view of the crimping tool 100. The first holding block 91 and the second holding block 92 are relatively opened.

Figure 9:
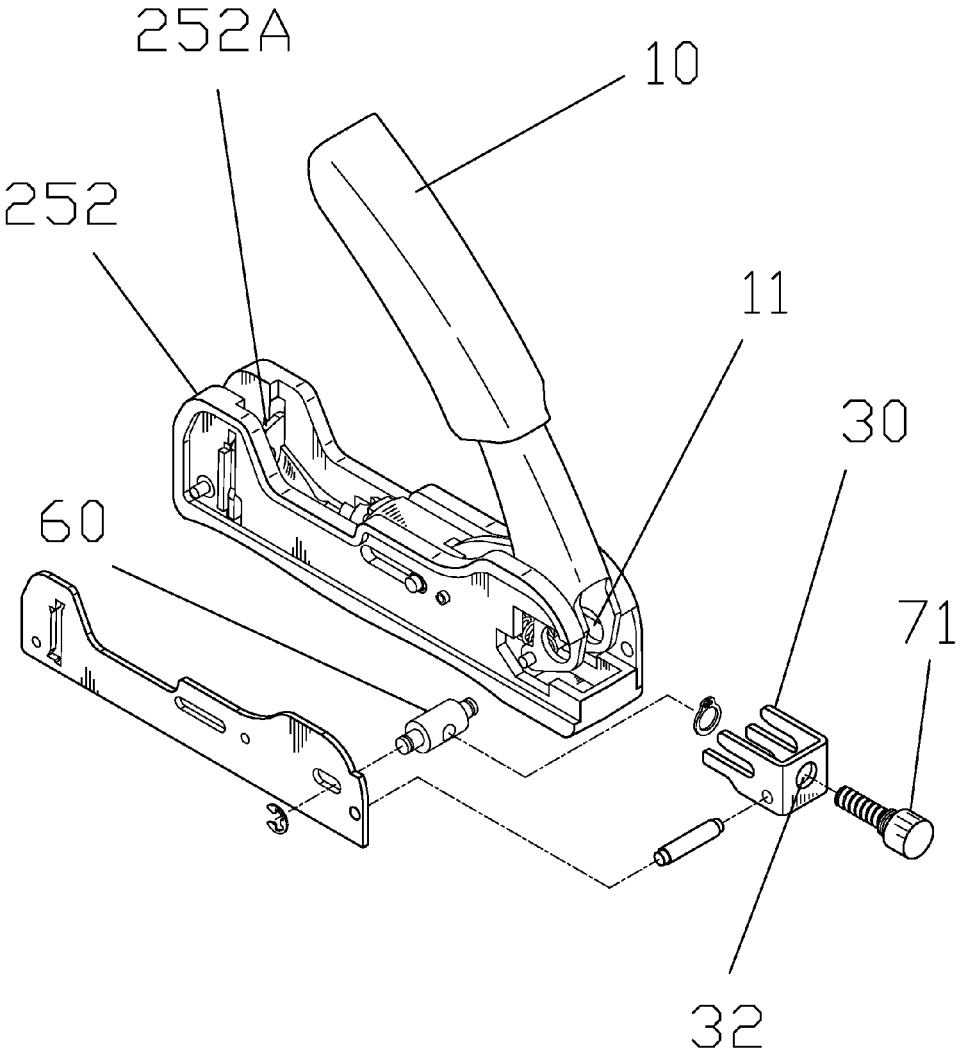
FIG. 9 is an exploded view of the crimping tool.

FIG. 9 is an exploded view of the crimping tool 100. Interconnections of the first through hole 11 of the first handle 10, the connector 60, the first screw hole 61, and the first screw rod 71 are shown.

Figure 10:
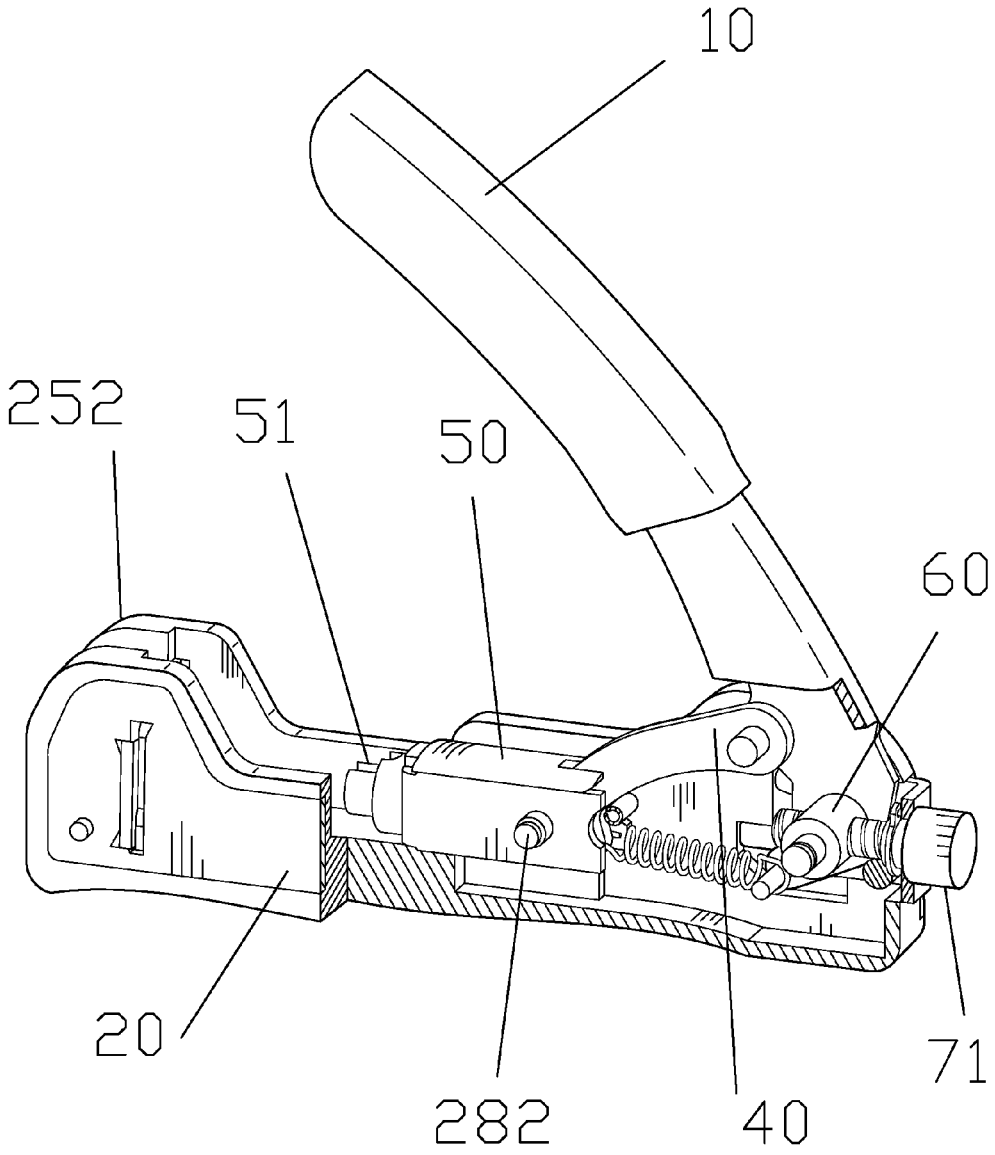
FIG. 10 is a perspective assembly view of the crimping tool.

FIG. 10 is a perspective assembly view of the crimping tool 100. Interconnections of the first handle 10, the connection rod 40, the crimp section 50, the crimp head 51, the connector 60, and the first screw rod 71 are shown.

Figure 11:
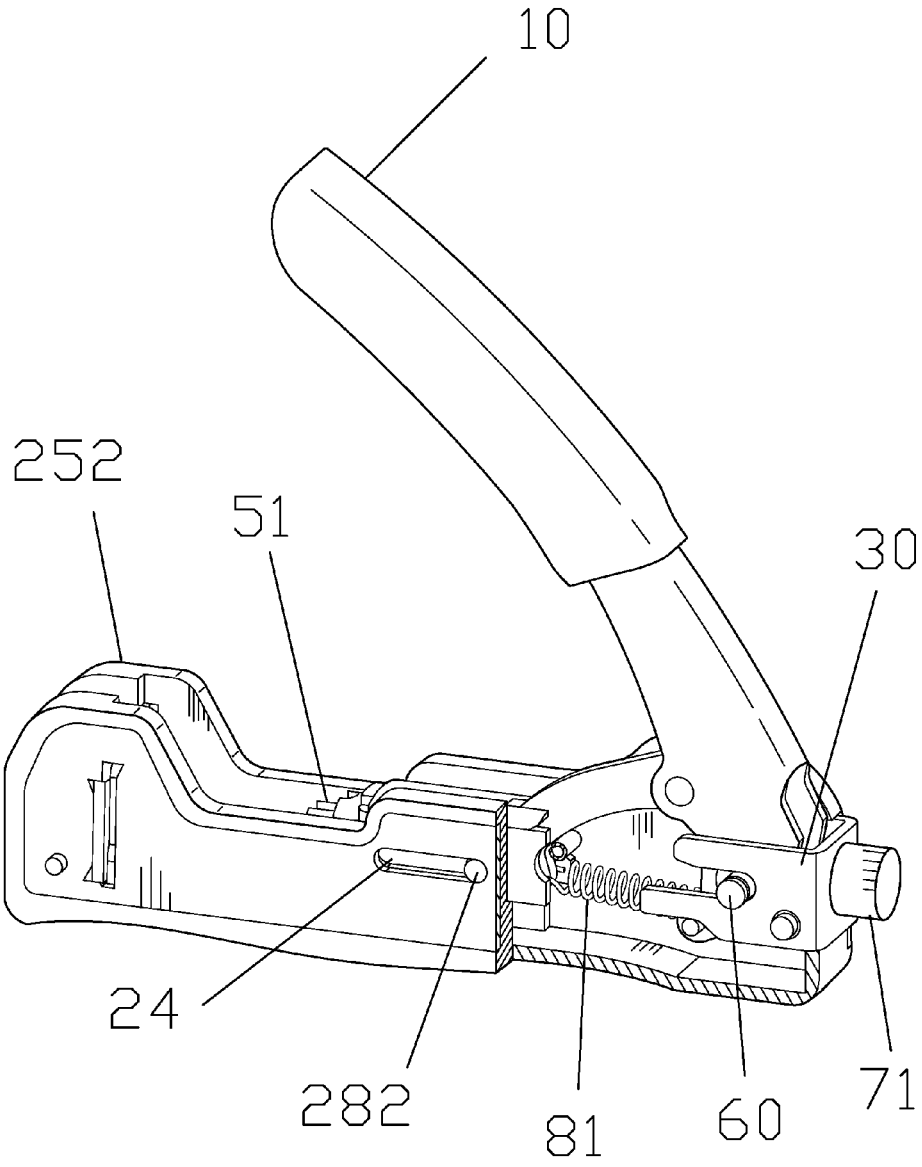
FIG. 11 is a perspective assembly view of the crimping tool.

FIG. 11 is a perspective assembly view of the crimping tool 100. Interconnections of the first handle 10, the adjustment part 30, the connector 60, and the first screw rod 71 are shown.

Figure 12:
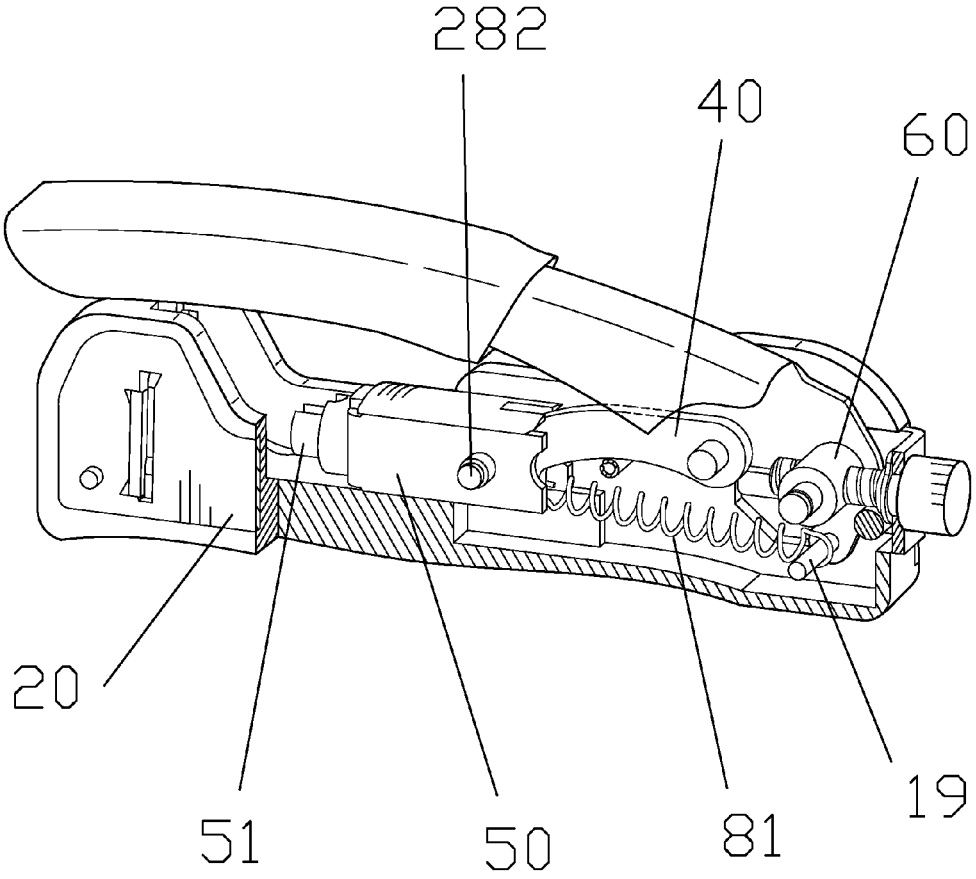
FIG. 12 is a perspective assembly view of the crimping tool.

FIG. 12 is a perspective assembly view of the crimping tool 100. Interconnections of the first handle 10, the connection rod 40, the first recovery spring 81, and the first linkage rod 19 are shown.

Figure 13:
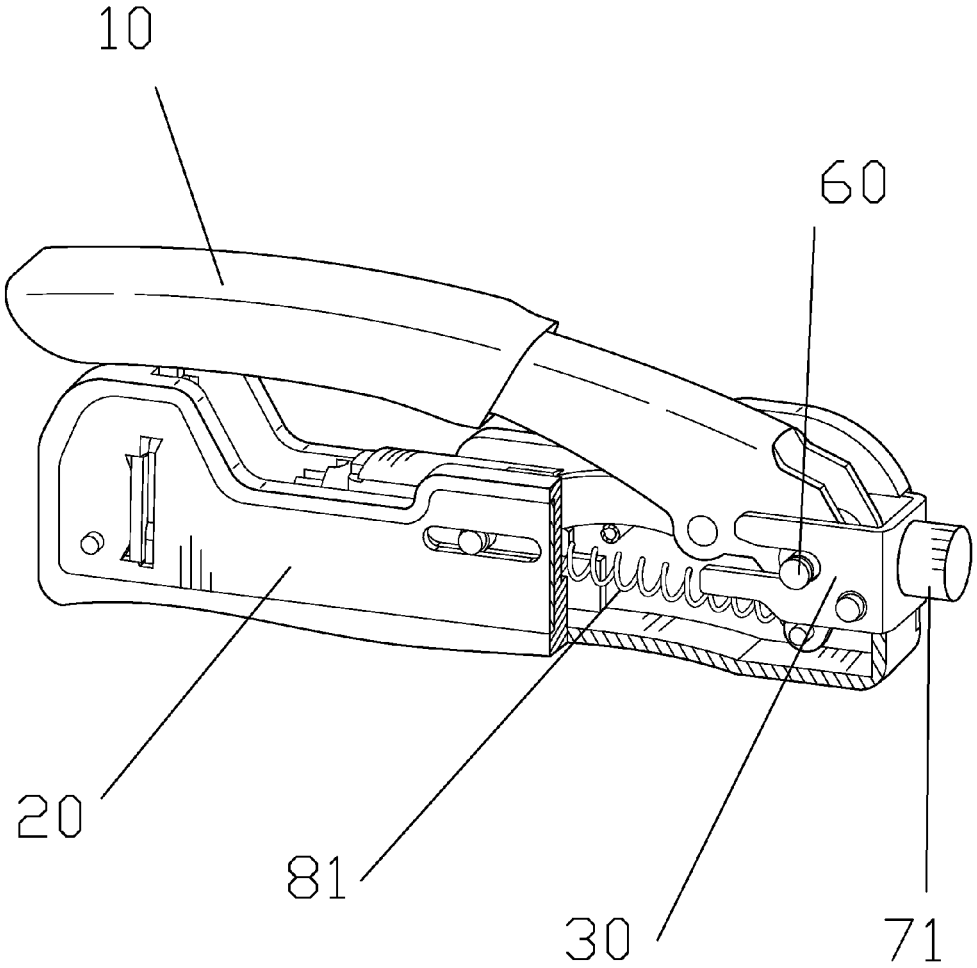
FIG. 13 is a perspective assembly view of the crimping tool.

FIG. 13 is a perspective assembly view of the crimping tool 100. Interconnections of the first handle 10, the adjustment part 30, the connector 60, and the first screw rod 71 are shown.

Figure 14A:
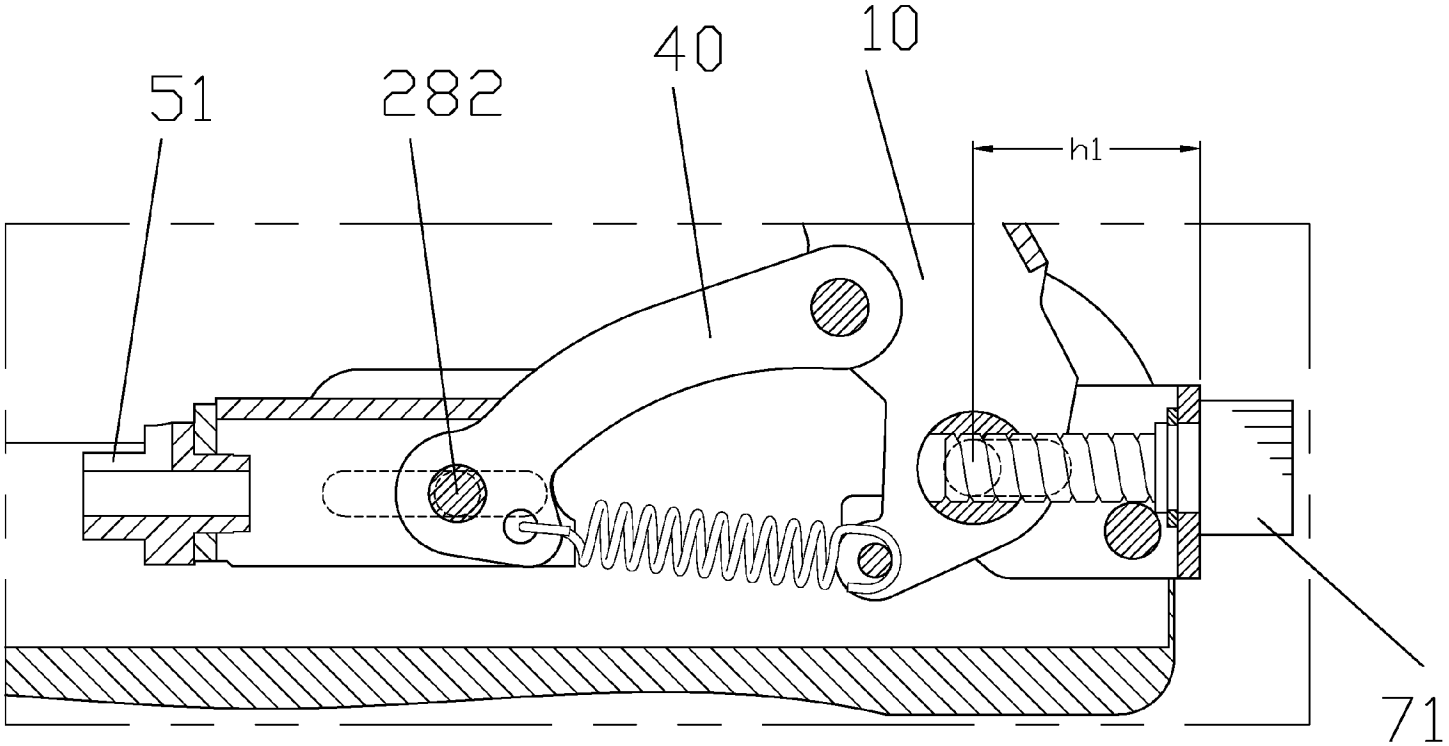
FIG. 14A is a side elevation showing the first handle displaced a first distance.
Figure 14B:
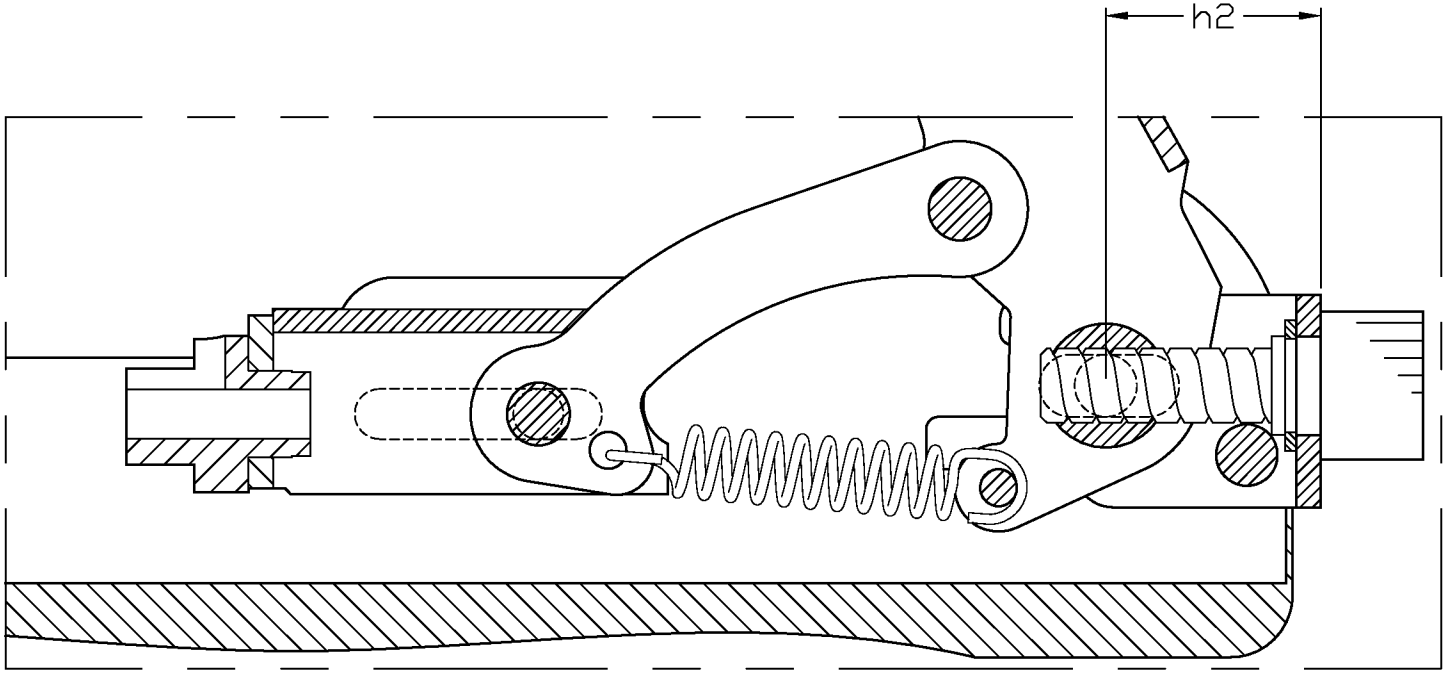
FIG. 14B is a side elevation showing the first handle displaced a second distance.
Figure 14C:
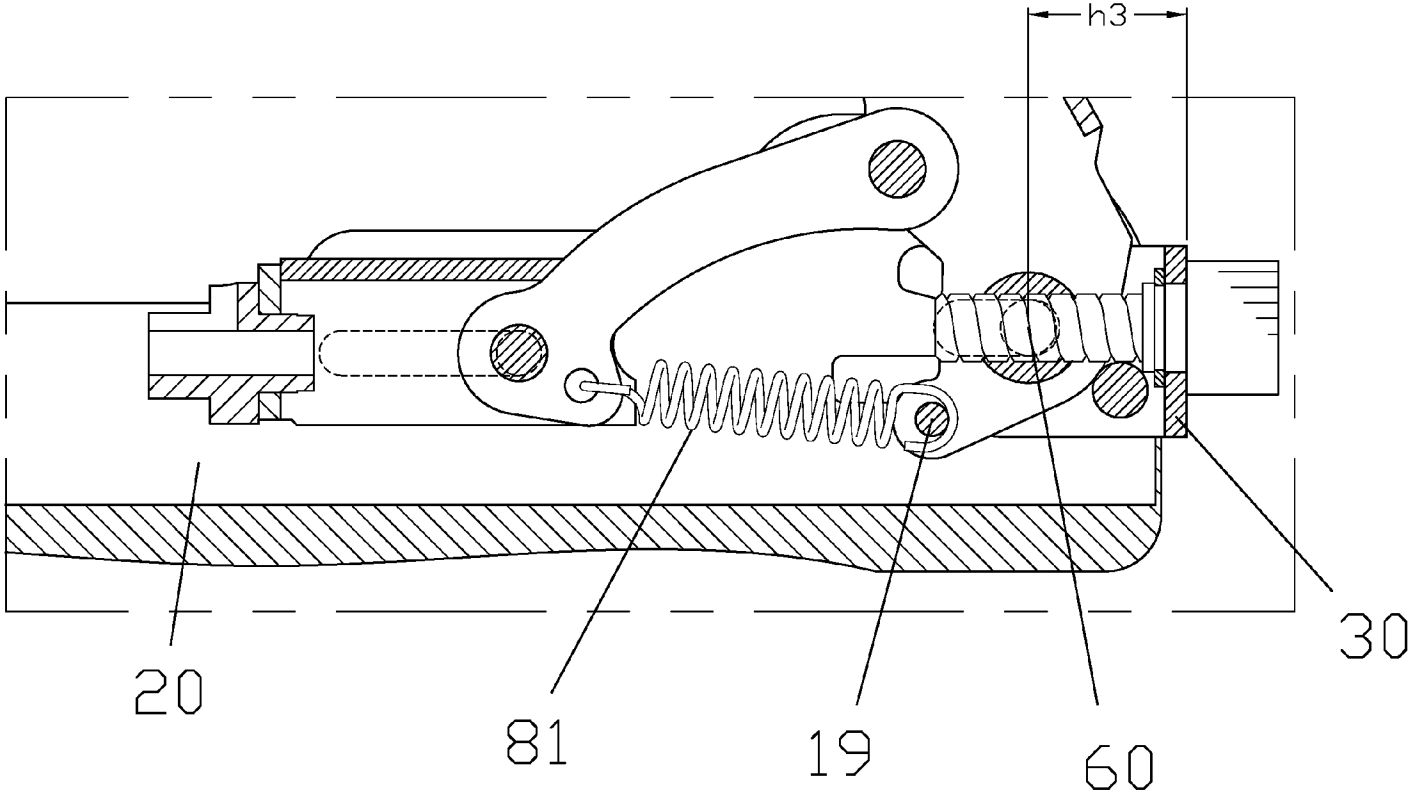
FIG. 14C is a side elevation showing the first handle displaced a third distance.

FIGS. 14A, 14B and 14C are side elevational assembly views showing the first handle displaced first, second and third distances respectively. As shown, the first screw rod 71 drives the connector 60 to displace, the connector 60 drives the first handle 10 to displace, and the first handle 10 drives the connection rod 40 to displace. Therefore, the location of the crimp section 50 can be adjusted. The first displacement distance h1 of the first handle 10 is greater than the second displacement distance h2, and the second displacement distance h2 is greater than the third displacement distance h3.

Figure 15:
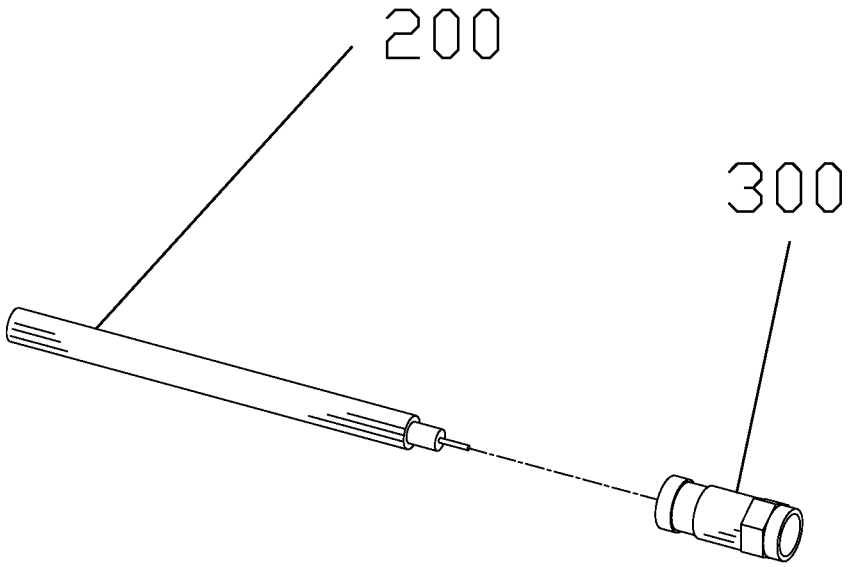
FIG. 15 is a perspective view showing the coaxial cable and shortened front of coaxial plug before being crimped.

FIG. 15 is a perspective view showing a coaxial cable 200 and shortened front of a coaxial plug 300 before being crimped.

Figure 16:
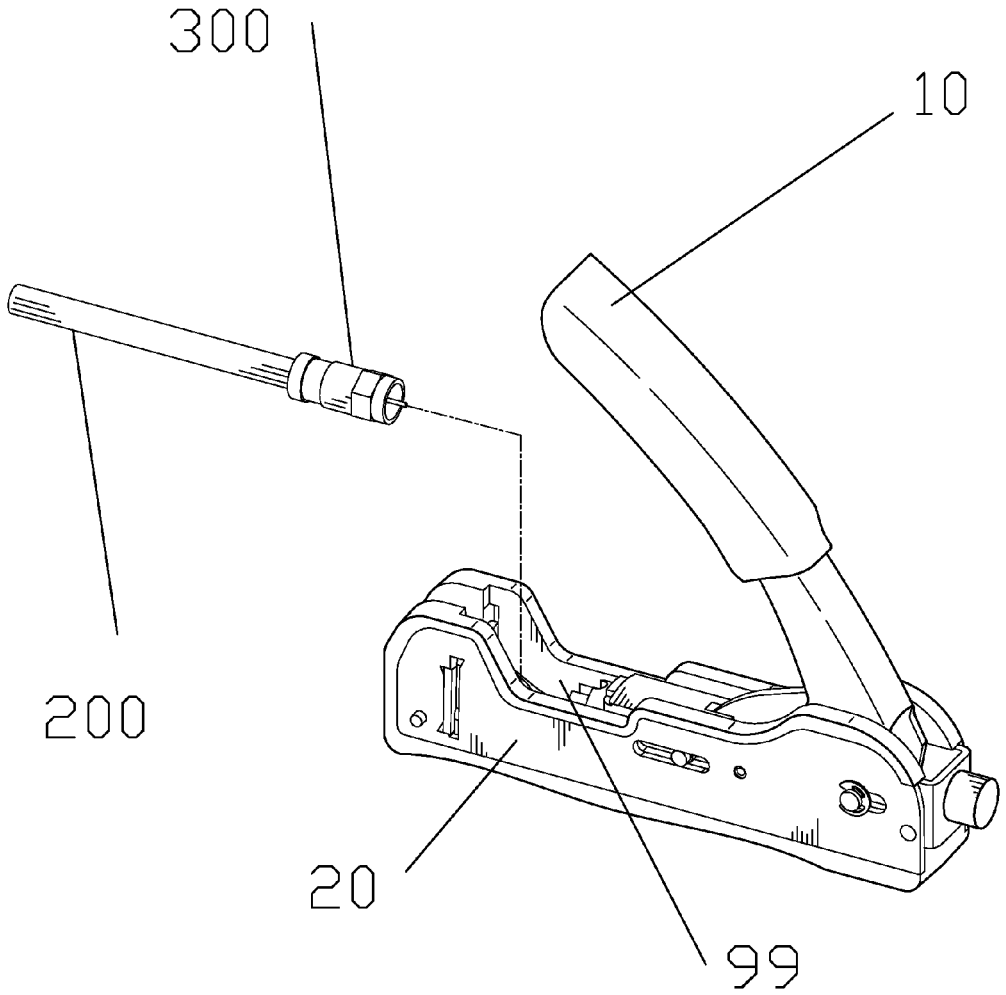
FIG. 16 is a perspective view showing the coaxial cable and shortened front of coaxial plug disposed in the space for coaxial cable and coaxial plug.
Figure 17:
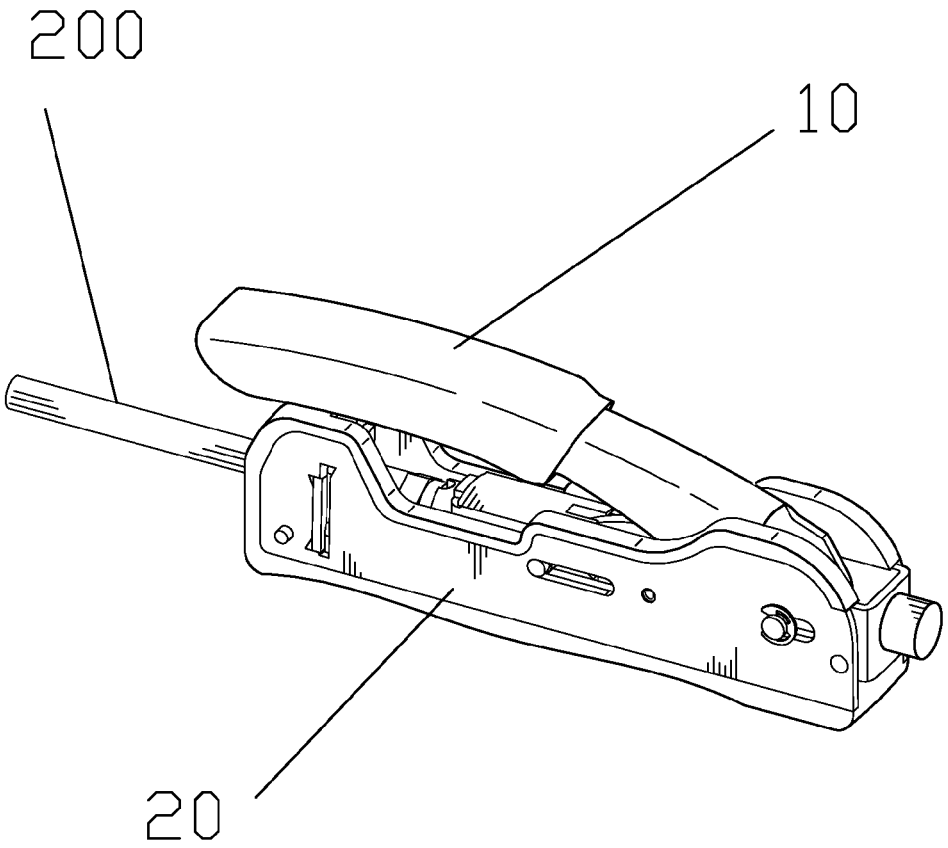
FIG. 17 is a perspective view showing the tool crimping coaxial cable and shortened front of coaxial plug.

FIG. 16 is a perspective view showing the coaxial cable 200 and the shortened front of the coaxial plug 300 being disposed in the space for the coaxial cable 200 and a coaxial plug 99.

Figure 18:
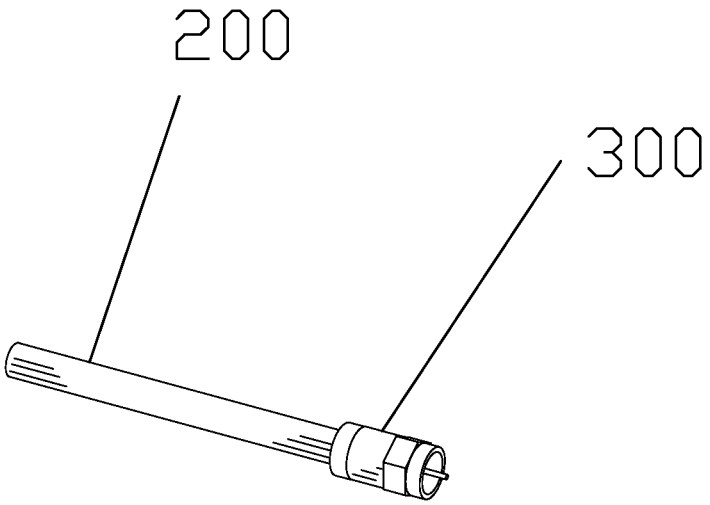
FIG. 18 is a perspective view showing the crimping tool coaxial cable and shortened front of coaxial plug after being crimped

FIG. 18 is a perspective view showing the coaxial cable 200 and the shortened front of the coaxial plug 300 after being crimped.

Figure 19:
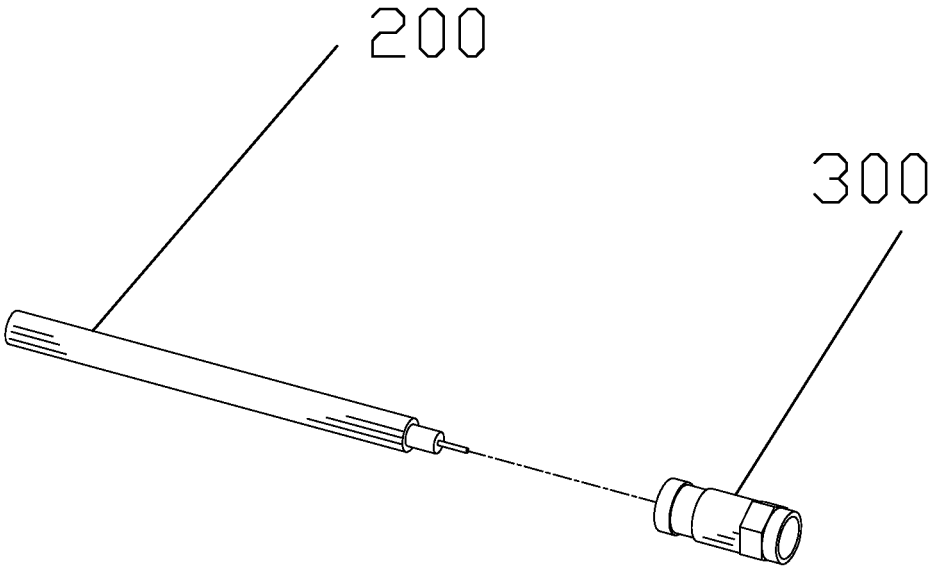
FIG. 19 is a perspective view showing the coaxial cable and coaxial plug having longer middle section before being crimped.

FIG. 19 is a perspective view showing the coaxial cable 200 and longer middle section of the coaxial plug 300 before crimped.

Figure 20:
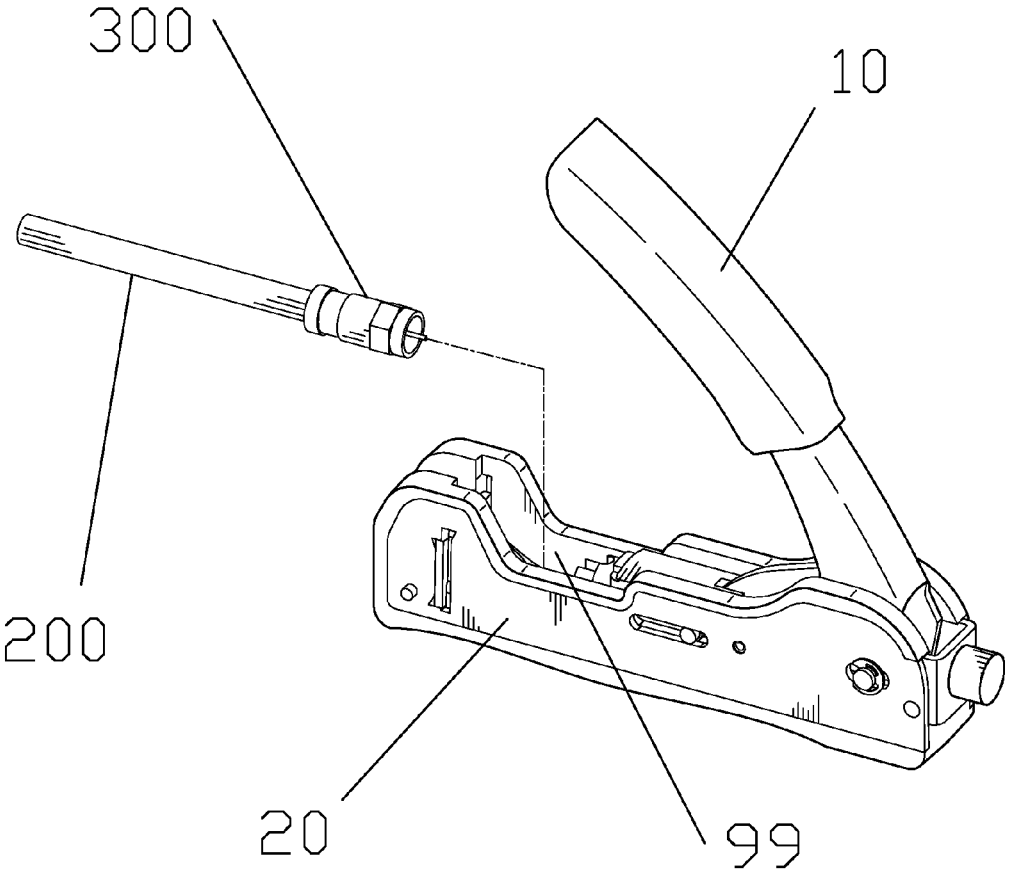
FIG. 20 is a perspective view showing the coaxial cable and coaxial plug having longer middle section placed within the space for coaxial cable and coaxial plug.

FIG. 20 is a perspective view showing the coaxial cable 200 and longer middle section of the coaxial plug 300 being placed within the space for the coaxial cable 200 and the coaxial plug 99.

Figure 21:
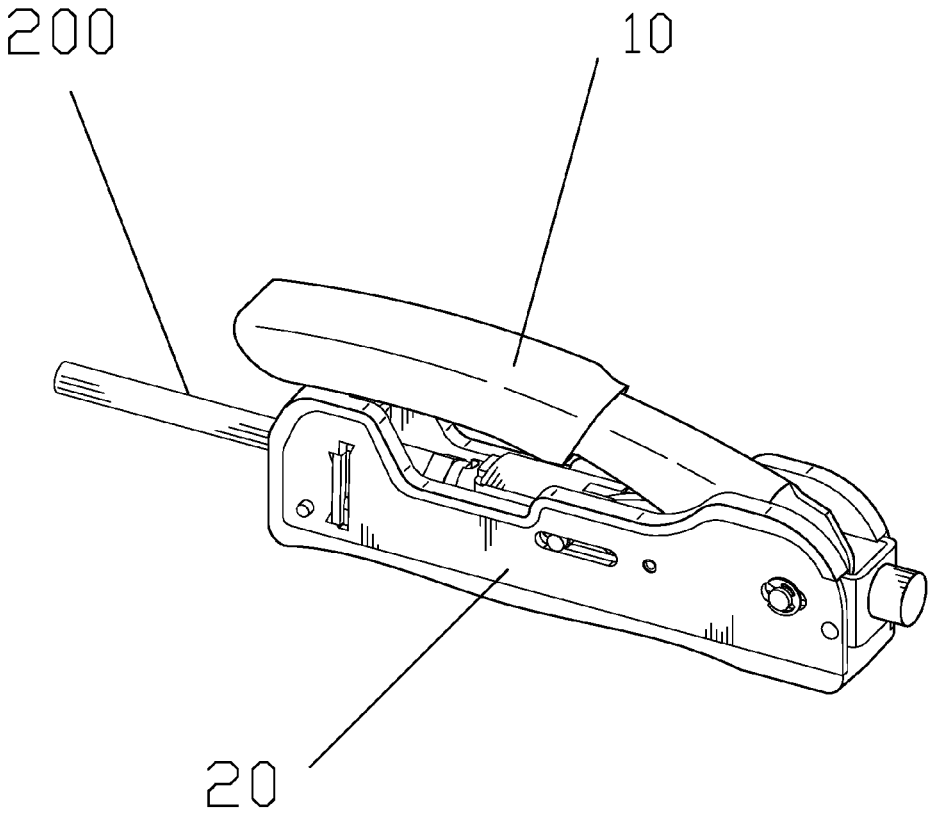
FIG. 21 is a perspective view showing the coaxial cable and coaxial plug having longer middle section.

FIG. 21 is a perspective view showing the coaxial cable 200 and longer middle section of the coaxial plug 300.

Figure 22:
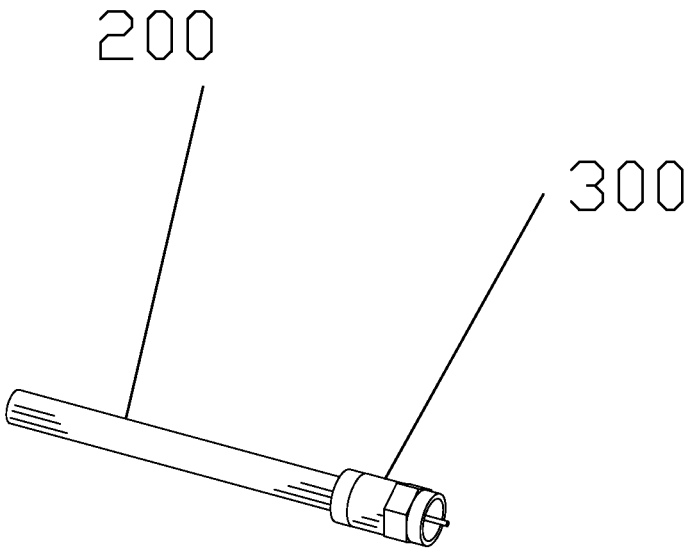
FIG. 22 is a perspective view showing the coaxial cable and coaxial plug having longer middle section after being crimped.

FIG. 22 is a perspective view showing the coaxial cable 200 and longer middle section of the coaxial plug 300 after being crimped.

Figure 23:
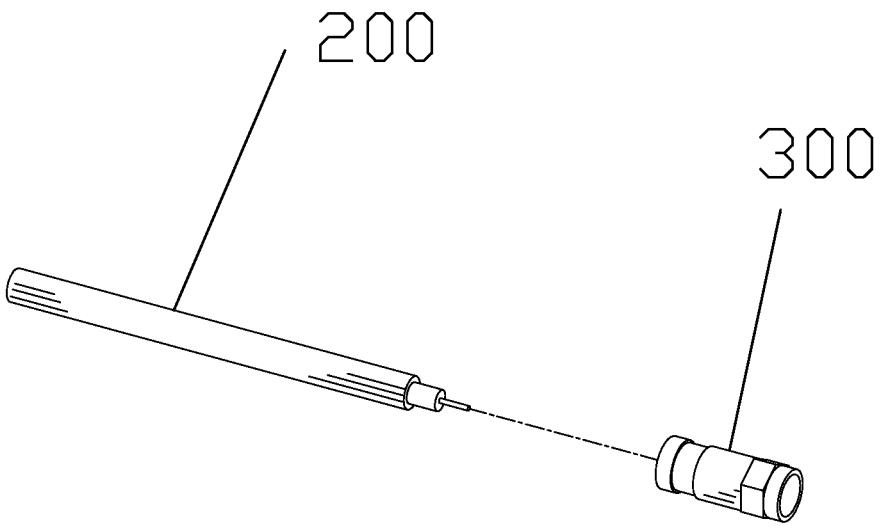
FIG. 23 is a perspective view showing the coaxial cable and coaxial plug having longer rear section before being crimped.

FIG. 23 is a perspective view showing the coaxial cable 200 and longer rear section of the coaxial plug 300 before being crimped.

Figure 24:
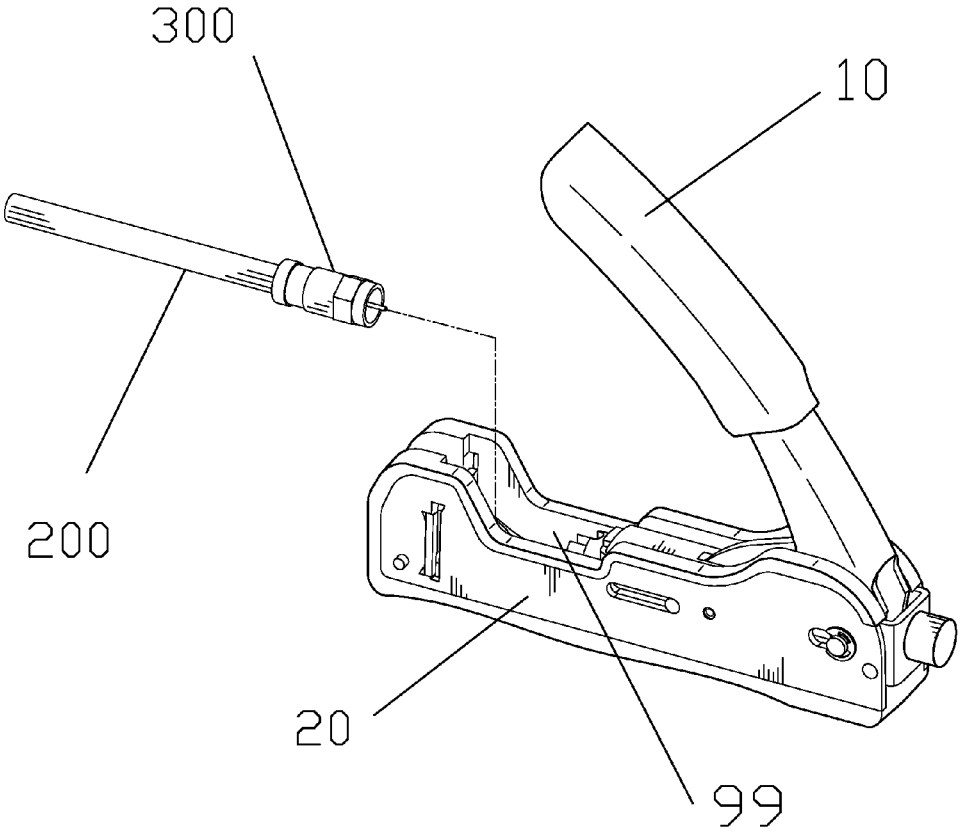
FIG. 24 is a perspective view showing the coaxial cable and coaxial plug having longer rear section being placed within the space for coaxial cable and coaxial plug.

FIG. 24 is a perspective view showing the coaxial cable 200 and longer rear section of the coaxial plug 300 being placed within the space for the coaxial cable 200 and the coaxial plug 99.

Figure 25:
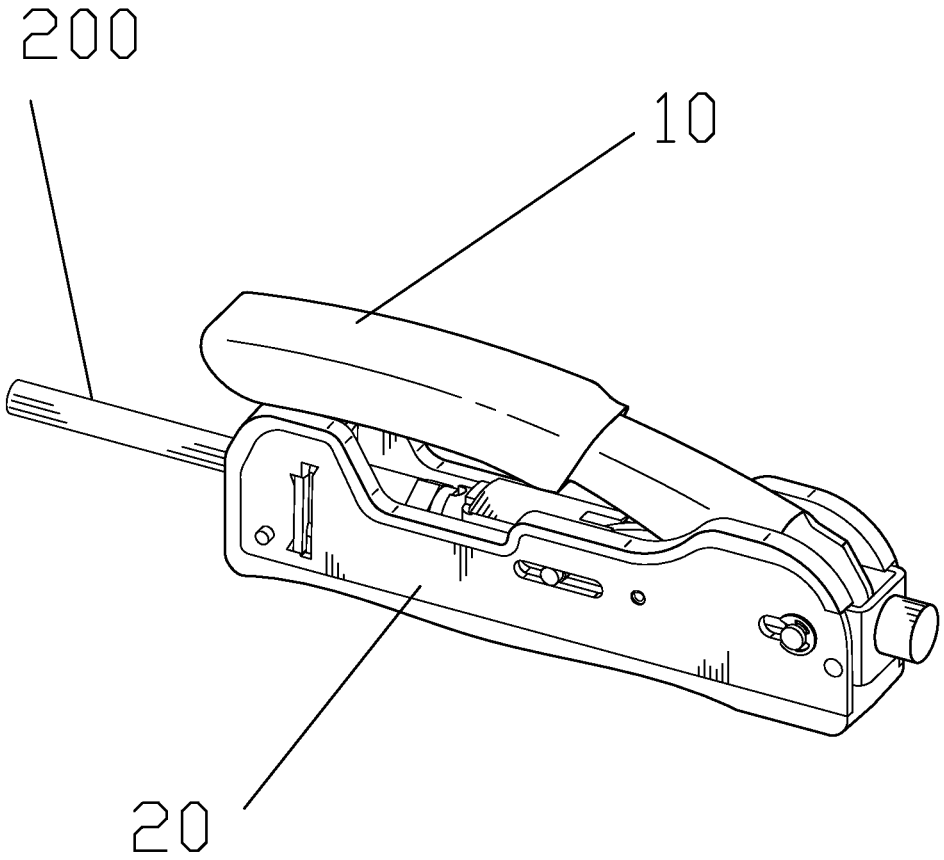
FIG. 25 is a perspective view showing the coaxial cable and coaxial plug having longer rear section.

FIG. 25 is a perspective view showing the coaxial cable 200 and the longer rear section of the coaxial plug 300.

Figure 26:
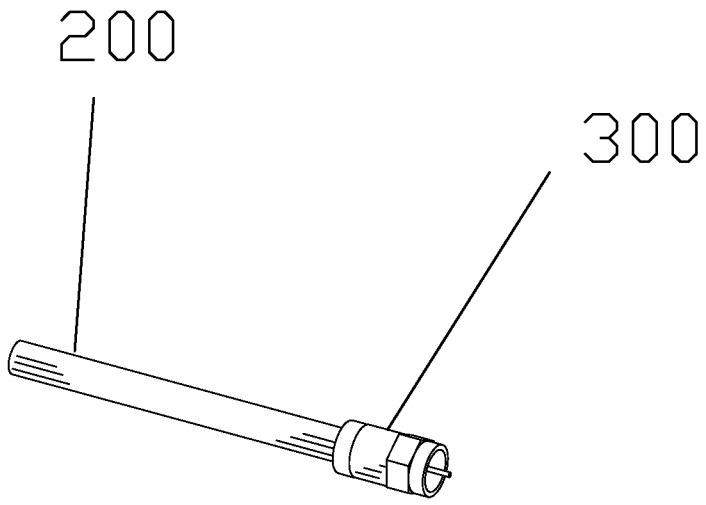
FIG. 26 is a perspective view showing the coaxial cable and coaxial plug having longer rear section after being crimped.

FIG. 26 is a perspective view showing the coaxial cable 200 and longer rear section of the coaxial plug 300 after being crimped.

Figure 27:
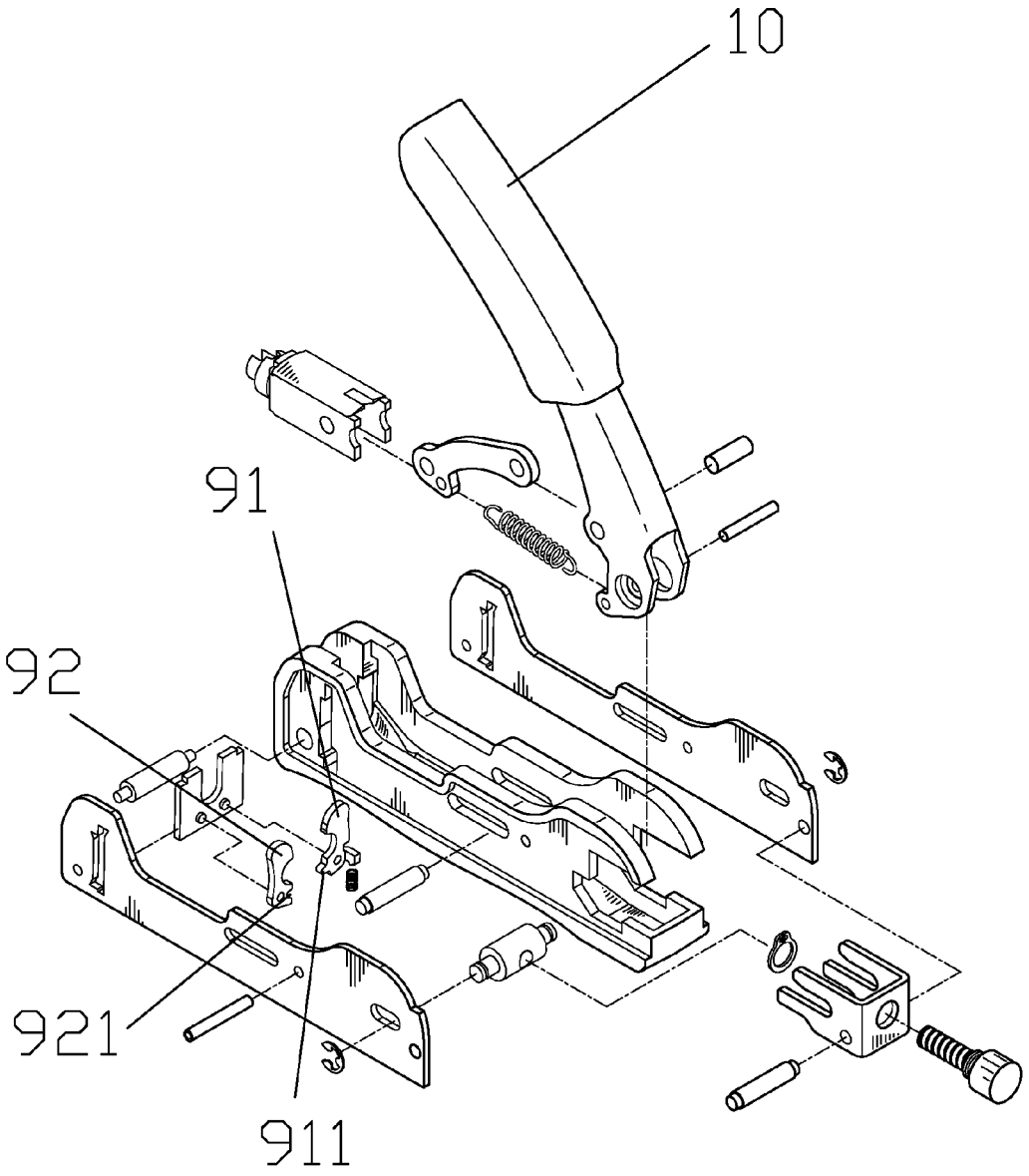
FIG. 27 is an exploded view of the crimping tool.

FIG. 27 is an exploded view of the crimping tool 100.

Figure 28:
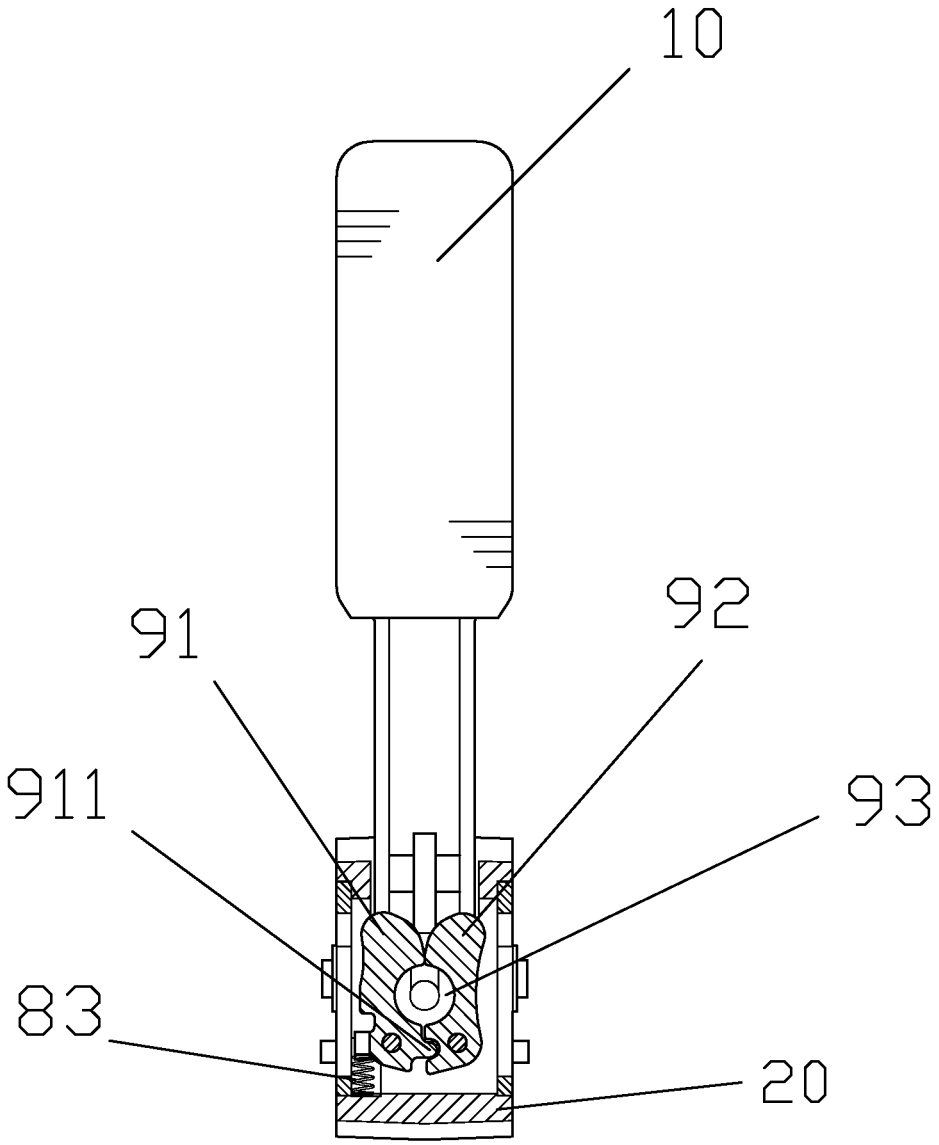
FIG. 28 is a left side view of the crimping tool.

FIG. 28 is a left side view of the crimping tool 100. As shown, a first holding block 91 is pivotally connected to rear end of the second handle 252, a protruding piece 911 is disposed at the first holding block 91, a second holding block 92 is pivotally connected to rear end of the second handle 252, a notch 921 is disposed at the second holding block 92, the protruding piece 911 is disposed inside the notch 921, the first holding block 91 and the second holding block 92 are relatively closed, and a third recovery spring 83 is placed above the second handle 20 and pushes against the first holding block 91.

Figure 29:
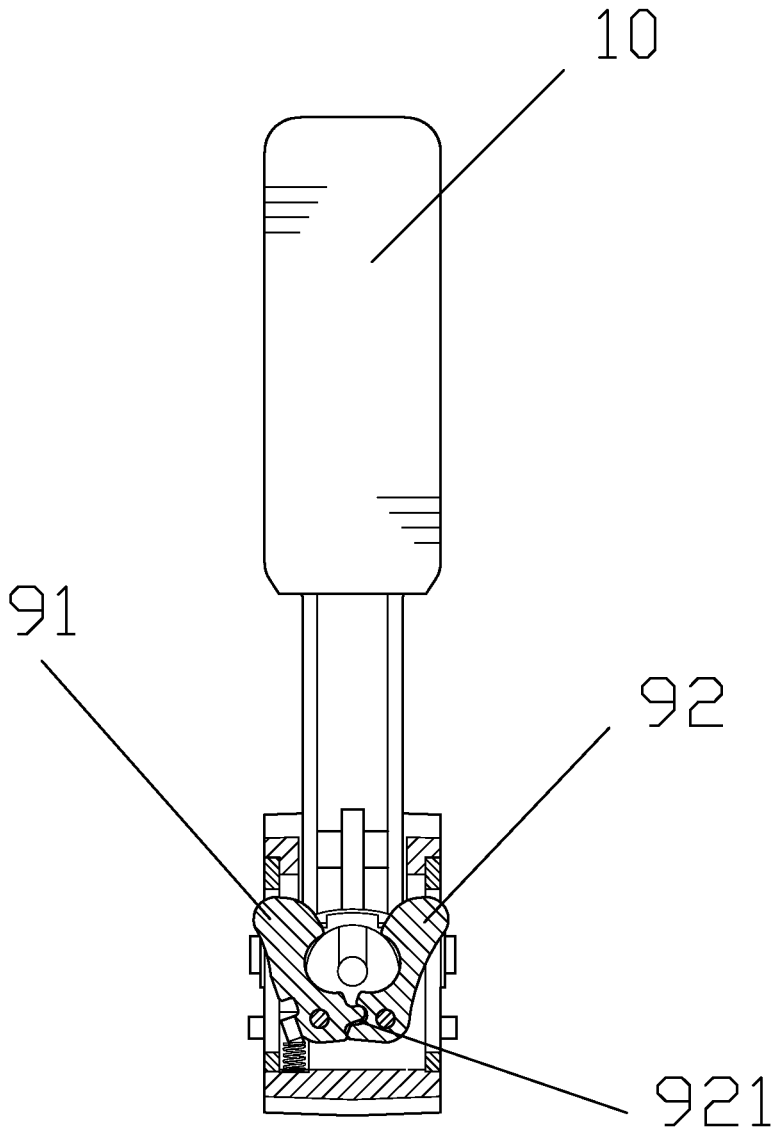
FIG. 29 is a left side view of the crimping tool.

FIG. 29 is a left side view of the crimping tool 100. As shown, a first holding block 91 is pivotally connected to rear end of the second handle 252, a protruding piece is disposed at the first holding block 91, a second holding block 92 is pivotally connected to rear end of the second handle 252, a notch 921 is disposed at the second holding block 92, the protruding piece 911 is disposed inside the notch 921, the first holding block 91 and the second holding block 92 are relatively opened, and a third recovery spring 83 is placed above the second handle 20 and pushes against the first holding block 91.

Figure 30A:
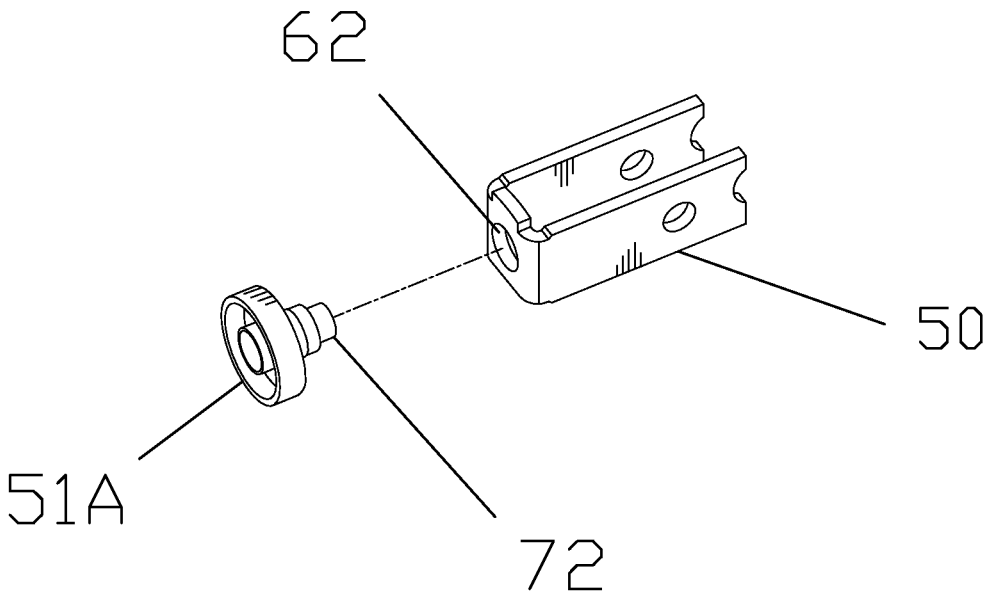
FIG. 30A is an exploded view of the crimp and a first embodiment of crimp head.

FIG. 30A is an exploded view showing a crimp section 50 and a crimp head 51A of a first embodiment having a second screw rod 72 to be fastened in the screw hole 62.

Figure 30B:
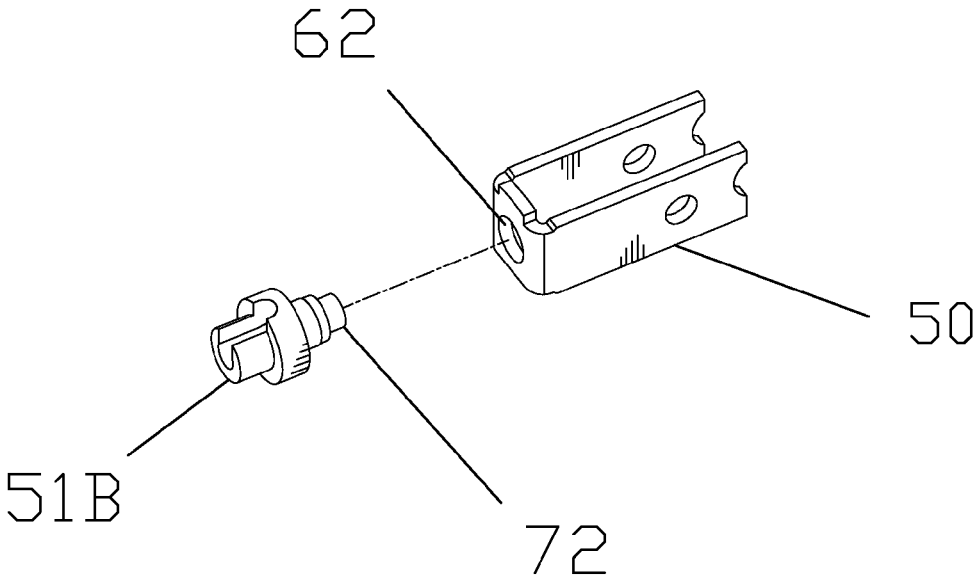
FIG. 30B is an exploded view of the crimp and a second embodiment of crimp head.

FIG. 30B is an exploded view showing a crimp section 50 and a crimp head 51B of a second embodiment having a second screw rod 72 to be fastened in the screw hole 62.

Figure 30C:
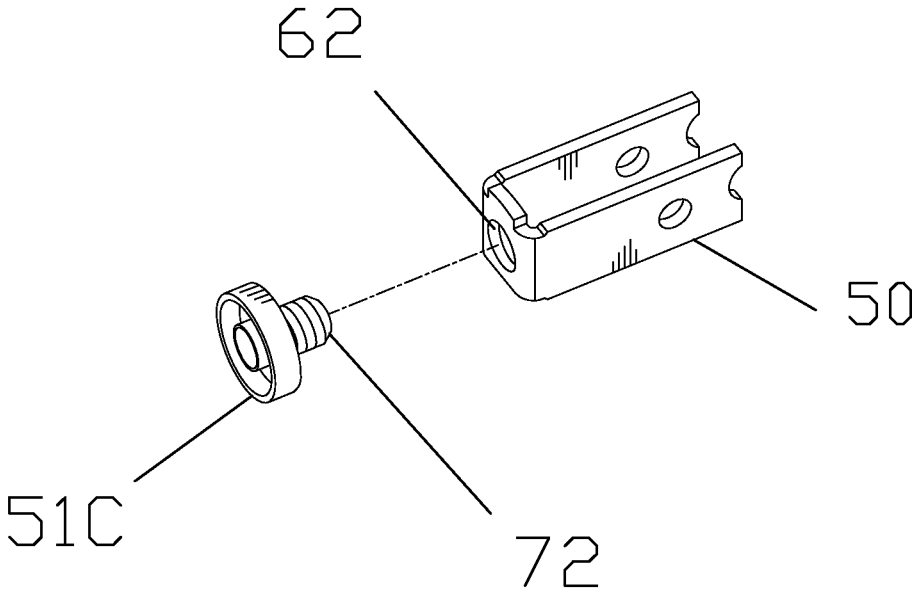
FIG. 30C is an exploded view of the crimp and a third embodiment of crimp head.

FIG. 30C is an exploded view showing a crimp section 50 and a crimp head 51C of a third embodiment of crimp head having a second screw rod 72 to be fastened in the screw hole 62.

As shown, a coaxial cable 200 and a coaxial plug 300 crimped together by the crimping tool 100 to form a single unit. The crimping tool 100 comprises a first handle 10, a first through hole 11*s* disposed at the first handle 10; a second handle 20, a first guide section 21, a second guide section 22, a third guide section 23 and a fourth guide section 24 disposed at the second handle 20, the second handle front section 251 being a hollow structure 251A, an adjustment part 30 disposed in the hollow structure 251A, a second through hole 32 disposed at the adjustment part 30, a connection rod 40 having one end pivotally connected to the first handle 10 and the other end of the connection rod 40 pivotally connected to a crimp section 50, one end of the crimp section 281 disposed in the third guide section 23, the other end of the crimp section 282 disposed in the fourth guide section 24, the third guide section 23 and the fourth guide section 24 served as displacement rails for the crimp section 50, a first screw hole 61 disposed at a connector 60, the first guide section 21 initially disposed in the connector 60 and then passing through one end of the adjustment part 30, the first through hole 11, and the other end of the adjustment part 30 prior to placing inside the second guide section 22, the connector 60 pivotally connected to the first handle 10 and the second handle 20, the first guide section 21 and the second guide section 22 served as displacement guide for the connector 60; a first screw rod 71 initially passing through the second through hole 32 and screwed into the first screw hole 61, the rotation of the first screw rod 71 driving the connector 60 to displace, the connector 60 then driving the first handle 10 to displace, the first handle 10 then driving the connection rod 40 to displace, thereby adjusting the location of the crimp section 50.

Moreover, a first linkage rod 19 is disposed at the first handle 10, one end of a first recovery spring 81 is connected to the first linkage rod 19, and the other end of the first recovery spring 81 is connected to the connection rod 40.

Moreover, a crimp head 51 is disposed at the crimp section 50. Therefore, the crimp head 51 is utilized during crimping operation.

Moreover, a hollow support block 252A is disposed at rear end of the second handle 252. Hence, a hollow support block 252A is served as support while crimping is in progress. A coaxial cable 200 can pass through the center void of the hollow support block 252A.

Moreover, a second screw rod 72 is disposed at the crimp head 51, a second screw hole 62 is disposed at the crimp section 50, and the second screw rod 72 screws into the second screw hole 62. The rotation of the second screw rod 72 adjusts the depth of the second screw rod 72 while being in the second screw hole 62, thereby achieving the position adjustment of the crimp head 51. Therefore, the depth of the second screw rod 72 is adjusted while being inside the second screw hole 62 by rotating the second screw rod 72. As a result, the location of the crimp head 51 is adjusted. Various positions of the crimp head 51 mean that crimping operation can perform against coaxial plug and coaxial cable of various specifications.

Moreover, a first holding block 91 is pivotally connected to rear end of the second handle 252, a second holding block 92 is pivotally connected to rear end of the second handle 252, the first holding block 91 is disposed next to the second holding block 92, and the first holding block 91 and the second holding block 92 form an annular run through placement space 93. Hence, both the first holding block 91 and the second holding block 92 are served as support during crimping. A coaxial cable 200 can be placed within the annular run through placement space 93. The coaxial cable 200 will not have any random movement while the crimping tool 100 performs crimping operation. Therefore, the quality of crimp join made by the crimping tool 100 is increased.

Moreover, a first holding block 91 is disposed at rear end of the second handle 252, a second holding block 92 is pivotally connected to rear end of the second handle 252, the first holding block 91 is disposed next to the second holding block 92, the first holding block 91 and the second holding block 92 together form an annular run through placement space 93; one end of the second recovery spring 82 is connected to the first holding block 91, and the other end of the second recovery spring 82 is connected to the second holding block 92. Hence, both the first holding block 91 and the second holding block 92 are served as support during crimping.

A coaxial cable 200 can be placed within the annular run through placement space 93. Rotating the first holding block 91 and the second holding block 92 can place the coaxial cable 200. After loosening and rotating, the second recovery spring 82 will cause the first holding block 91 to restore to its original position, and the second holding block 92 will also restore to its original position. During crimping operation by using the crimping tool 100, the coaxial cable will not have any random movement. Therefore, the invention can increase the quality of crimp joining a coaxial cable.

Moreover, a first holding block 91 is pivotally connected to rear end of the second handle 252, a protruding piece 911 is disposed at the first holding block 91, a second holding block 92 is pivotally disposed at rear end of the second handle 252, a notch 921 is disposed at the second holding block 92, and the protruding piece 911 is disposed in the notch 921; and a third recovery spring 83 is placed on top of the second handle 20 and pushes against the first holding block 91. Hence, both the first holding block 91 and the second holding block 92 are served as support while crimping is in progress. A coaxial cable 200 can be placed within the annular run through placement space 93. Applying a rotational force causes the first holding block 91 to press downward against the third recovery spring 83. After releasing the rotational force, the third recovery spring 83 restores to its original position to push the first holding block 91 so that the first holding block 91 can restore to its original position. The protruding piece 911 will push the notch 921 to rotate so that the second holding block 92 is driven to rotate and restore to its original position. The coaxial cable 200 will not have any random movement while the crimping tool 100 performs crimping operation. Therefore, the quality of crimp made by the crimping tool 100 is increased.

While the invention has been described in terms of preferred embodiments, those skilled in the art will recognize that the invention can be practiced with modifications within the spirit and scope of the appended claims.

What is claimed is:

1. A crimping tool for crimping a coaxial cable and a coaxial plug into a single unit, the crimping tool comprising:

a first handle;

a first through hole disposed at the first handle;

a second handle having a hollow front section;

a first guide section, a second guide section, a third guide section, and a fourth guide section all disposed at the second handle;

an adjustment part disposed in the hollow front section of the second handle; a second through hole disposed at the adjustment part;

a connection rod having one end pivotally connected to the first handle and the other end of the connection rod pivotally connected to a crimp section wherein one end of the crimp section is disposed in the third guide section, and the other end of the crimp section is disposed in the fourth guide section;

a connector wherein one end of the connector disposed in the first guide section passes through one end of the adjustment part, the first through hole, and the other end of the adjustment part into the second guide section, wherein the connector pivotally connects the first handle to the second handle such that when the first handle is pivoted about the connector, the connection rod drives the crimp section along the second handle via the third guide section and the fourth guide section;

a first screw hole disposed at the connector; and a first screw rod passing through the second through hole and screwing into the first screw hole so that a rotation of the first screw rod drives the connector to displace along the second handle via the first guide section and the second guide section, the displaced connector drives the first handle to displace along the second handle, and the displaced first handle drives the connection rod to displace, thereby adjusting a location of the crimp section.

2. The crimping tool as defined in claim 1, wherein a first linkage rod is disposed at the first handle, one end of a first recovery spring connects to the first linkage rod, and the other end of the first recovery spring connects to the connection rod.

3. The crimping tool as defined in claim 2, further comprising a hollow support block disposed at a rear end of the second handle.

4. The crimping tool as defined in claim 3, further comprising a crimp head disposed at the crimp section.

5. The crimping tool as defined in claim 4, wherein a second screw rod is disposed at the crimp head, the crimp section includes a second screw hole, and the second screw rod screws into the second screw hole so that a rotation of the second screw rod adjusts depth of a penetrating position in the second screw hole, thereby adjusting a position of the crimp head.

6. The crimping tool as defined in claim 4, further comprising a first holding block pivotally connected to the rear end of the second handle, and a second holding block pivotally connected to the rear end of the second handle, wherein the first holding block is adjacent to the second holding block so that an annular run through placement space is formed by the first holding block and the second holding block.

7. The crimping tool as defined in claim 6, wherein the second screw hole is disposed at the crimp section, a second screw rod is disposed at the crimp head, and the second screw rod screws into the second screw hole so that a rotation of the second screw rod adjusts depth of a penetrating position in the second screw hole, thereby adjusting a position of the crimp head.

8. The crimping tool as defined in claim 4, wherein a first holding block is pivotally connected to the rear end of the second handle, a second holding block is pivotally connected to the rear end of the second handle, and the first holding block is adjacent to the second holding block so that an annular run through placement space is formed by the first holding block and the second holding block; and one end of a second recovery spring connects to the first holding block, and the other end thereof connects to the second holding block.

9. The crimping tool as defined in claim 8, wherein the second screw hole is disposed at the crimp section, the second screw is disposed at the crimp head, and the second screw rod screws into the second screw hole so that a rotation of the second screw rod adjusts depth of a penetrating position in the second screw hole, thereby adjusting a position of the crimp head.

10. The crimping tool as defined in claim 4, wherein a first holding block is pivotally connected to the rear end of the second handle, the first holding block includes a protruding piece, a second holding block is pivotally disposed at the rear end of the second handle, the second holding block includes a notch, and the protruding piece is disposed in the notch, further comprising a third recovery spring disposed above the second handle and configured to urge against the first holding block or the second holding block.

11. The crimping tool as defined in claim 10, wherein the second screw hole is disposed at the crimp section, the second screw rod is disposed at the crimp head, and the second screw rod screws into the second screw hole so that a rotation of the second screw rod adjusts depth of a penetrating position in the second screw hole, thereby adjusting position of the crimp head.

* * * * *